US006154911A

United States Patent [19]

Vanderlinden

[11] Patent Number: 6,154,911

[45] Date of Patent: Dec. 5, 2000

[54] DEBRIS LIFTING APPARATUS FOR USE IN A SURFACE SWEEPING VEHICLE

[76] Inventor: Roger P. Vanderlinden, 73 Sherman Ave. S., Hamilton, Canada, L8M 2P8

[21] Appl. No.: 09/253,748

[22] Filed: Feb. 22, 1999

[51] Int. Cl.[7] ..... E01H 1/04

[52] U.S. Cl. ..... 15/85; 15/83; 414/501

[58] Field of Search ..... 15/78, 82, 83, 15/85, 87, 340.3, 340.4; 414/408, 421, 501

[56] References Cited

U.S. PATENT DOCUMENTS

| | | | |
|---|---|---|---|
| Re. 6,153 | 11/1874 | Smith | 15/83 |
| 141,808 | 8/1873 | Morton | 15/85 |
| 436,520 | 9/1890 | Fisher | 15/85 |
| 491,278 | 2/1893 | Bertram | 15/85 |
| 537,278 | 4/1895 | Doherty | 15/85 |
| 730,502 | 6/1903 | Whittemore | 15/85 |
| 810,547 | 1/1906 | Menzies | 15/83 |
| 1,100,808 | 6/1914 | Wilson | 15/87 |
| 2,911,737 | 11/1959 | Von Arx | 15/83 |

*Primary Examiner*—Terrence R. Till

[57] ABSTRACT

A debris lifting apparatus for use in a surface sweeping vehicle comprises an isolated debris lifting receptacle mounted on the surface sweeping vehicle for arrested positioning in a lower debris receiving position, whereat the debris lifting receptacle is disposed to receive and retain the debris propelled forwardly by a rotating sweeping broom, and for positioning in a raised debris dumping position, whereat the debris lifting receptacle is disposed to dump the debris into a hopper. A drive mechanism mounted on the surface sweeping vehicle drives the debris lifting receptacle to effect movement of the debris lifting receptacle between the lower debris receiving position and the raised debris dumping position. A dumping mechanism mounted on the surface sweeping vehicle effects dumping of the debris from the debris lifting receptacle into the hopper when the debris lifting receptacle is in the raised debris dumping position. A method of lifting debris into the hopper of a surface sweeping vehicle comprises the steps of arrestedly positioning an isolated debris lifting receptacle in a lower debris receiving position; propelling debris via a rotating sweeping broom; receiving the forwardly propelled debris in the debris lifting receptacle; transferring the debris lifting receptacle to a raised debris dumping position, while the rotating sweeping broom is propelling the debris forwardly; dumping debris from the debris lifting receptacle into the hopper; and returning the debris lifting receptacle to the lower debris receiving position; and, repeating the above steps during the operation of the surface sweeping vehicle.

17 Claims, 16 Drawing Sheets

DEBRIS LIFTING APPARATUS FOR USE IN A SURFACE SWEEPING VEHICLE

FIELD OF THE INVENTION

The present invention relates to surface sweeping vehicles, such as street sweeping vehicles, factory sweepers, and the like, and more particularly to an debris lifting apparatus for use in a surface sweeping vehicle for lifting debris into a hopper. Further, the present invention relates to method of lifting debris into the hopper of a surface sweeping vehicle.

BACKGROUND OF THE INVENTION

Conventional mechanical street sweeping vehicles that sweep up dirt and debris and ultimately deposit it into a hopper have been known for several years. They typically are manufactured on their own frame or on a truck frame, and have a pair of counter-rotating brooms disposed one at each side of the street sweeping vehicle. These counter-rotating brooms sweep dirt and debris from the edges of a road, or the like, even from against a sidewalk curb, to underneath the central area of the street sweeping vehicle. An elongate drum-shaped sweeping broom is disposed at the rear of the street sweeping vehicle and rotates about a horizontal axis to sweep the dirt and debris on the road forwardly to an upwardly inclined conveyor that receives the dirt and debris and conveys the dirt and debris into a hopper for subsequent controlled dumping from the hopper.

All known prior art conveyors used in mechanical street sweepers are belt type conveyors having a flexible conveyor belt looped around a horizontal idler shaft disposed immediately ahead of the sweeping broom, and a raised remote drive shaft, so as to present upper and lower straight spans of the conveyor belt between the two shafts. The flexible conveyor belt travels in one rotational direction only while in use. However, they are usually reversible, if necessary, for maintenance purposes.

There are two specific kinds of belt type conveyors. One kind, namely a carrying conveyor, comprises a number of spaced apart substantially rigid cleats, with each cleat disposed across the width of the conveyor belt. Dirt and debris are swept forwardly by the sweeping broom onto the bottom portion of the upper straight span of the conveyor belt, essentially adjacent the idler shaft, and are carried on the upper span of the conveyor belt to be dumped off the top end of the conveyor belt, adjacent the drive shaft, into the hopper. The cleats preclude the dirt and debris from sliding down the upper straight span of the conveyor belt.

The other kind of belt type conveyor, namely a drag conveyor, comprises a number of spaced apart somewhat flexible cleats, commonly known as "squeegees", disposed each one across the width of the conveyor belt. The carrying conveyor additionally comprises a conveyor bed disposed immediately below and parallel to the lower straight span of the conveyor belt such that the squeegees drag along the conveyor bed so as to drag dirt and debris up the conveyor bed, and push the dirt and debris off the top end of the conveyor bed into the hopper. It is necessary that the squeegees be somewhat flexible in order to make substantially sealing sliding contact with the conveyor bed, so that dirt and debris, and even mud and water, are dragged up the conveyor bed. The conveyor bed terminates at its lower end in a curved lower lip that follows the arc of the distal edge of the squeegees as they arcuately traverse the bottom end of the conveyor.

Both of the above described kinds of belt type conveyors have a number of significant problems associated with them.

Dirt and debris tend to cause severe abrasion of the conveyor belts, cleats, drive chains, sprockets, bearings, elevator bed plate, and so on, thus causing these parts to wear quickly. The replacement of these parts is typically quite frequent, perhaps every few months, and is labour intensive, and therefore very expensive. Further, in carrying conveyors, it is necessary to have the bottom portion of the conveyor close to the ground in order to be properly positioned to receive dirt and debris from the sweeping broom. Therefore, carrying conveyors must have short cleats, since the cleats must clear the ground. Accordingly, such carrying conveyors cannot convey large debris, such as tire pieces, tree branches, and so on, and almost certainly jam when large debris is encountered. Some types of large debris also tend to become tangled in the sprockets, drive chains, and so on.

Further, in drag conveyors, it is necessary that the flexible squeegees be short so that they will bend only minimally when pushing a heavy mass of dirt and debris up the conveyor bed. Another problem with drag conveyors is that the metal base within the squeegee tends to bend when impacted by large or heavy objects. Once the metal base is bent, the squeegee cannot traverse around the upper and lower shafts, and must be replaced.

It is an object of the present invention to provide an apparatus for lifting dirt and debris swept forwardly by the sweeping broom and depositing the dirt and debris into a hopper.

It is another object of the present invention to provide an apparatus for lifting dirt and debris swept forwardly by the sweeping broom and depositing the dirt and debris into a hopper, which apparatus requires less frequent replacement of parts as compared to prior art conveyors.

It is another object of the present invention to provide an apparatus for lifting dirt and debris swept forwardly by the sweeping broom and depositing the dirt and debris into a hopper, which apparatus has improved wear characteristics and lower maintenance costs as compared to prior art conveyors.

It is yet another object of the present invention to provide an apparatus for lifting dirt and debris swept forwardly by the sweeping broom and depositing the dirt and debris into a hopper, which apparatus can lift large debris without jamming.

It is still another object of the present invention to provide an apparatus for lifting dirt and debris swept forwardly by the sweeping broom and depositing the dirt and debris into a hopper, the parts of which apparatus are not readily bent or otherwise damaged.

SUMMARY OF THE INVENTION

In accordance with the foregoing and with one aspect of the present invention, there is provided a novel debris lifting apparatus for use in a surface sweeping vehicle having a rotating sweeping broom and a hopper. The debris lifting apparatus comprises an isolated debris lifting receptacle operatively mounted on the surface sweeping vehicle by a receptacle mounting means for arrested positioning in a lower debris receiving position, whereat the isolated debris lifting receptacle is disposed to receive and retain the debris propelled forwardly by the rotating sweeping broom, and for positioning in a raised debris dumping position, whereat the isolated debris lifting receptacle is disposed to dump the debris retained therein into the hopper. A selectively operable drive means is mounted on the surface sweeping vehicle and is connected in driving relation to the isolated debris lifting receptacle to effect movement of the isolated debris lifting receptacle between the lower debris receiving position and the raised debris dumping position. A dumping means is mounted on the surface sweeping vehicle to effect dumping of the debris from the isolated debris lifting receptacle into the hopper when the isolated debris lifting receptacle is in the raised debris dumping position.

In accordance with the foregoing and with another aspect of the present invention, there is provided a novel method of lifting debris into the hopper of a surface sweeping vehicle having a rotating sweeping broom. The method comprises the steps of: arrestedly positioning an isolated debris lifting receptacle in a lower debris receiving position; propelling the debris forwardly and upwardly from a surface being cleaned; receiving the forwardly propelled debris in the isolated debris lifting receptacle; transferring the isolated debris lifting receptacle to a raised debris dumping position, while the rotating sweeping broom is propelling the debris forwardly; dumping the debris into the hopper; returning the isolated debris lifting receptacle to the lower debris receiving position; and, repeating the above steps during the operation of the surface sweeping vehicle.

In accordance with the foregoing and with yet another aspect of the present invention, there is provided a novel stop wall for use in a debris lifting apparatus mounted in a surface sweeping vehicle. The debris lifting apparatus includes an isolated debris lifting receptacle having a lower debris receiving position and a raised debris dumping position, a debris receiving tray mounted on the surface sweeping vehicle between the rotating sweeping broom and the debris lifting apparatus so as to receive debris swept forwardly by the rotating sweeping broom. The stop wall comprises a top edge, a bottom edge, a left side edge, a right side edge, and a debris impinging surface. The stop wall is operatively mounted on the surface sweeping vehicle for return movement from a debris passing position temporally coincident with the lower debris receiving position of the isolated debris lifting receptacle and whereat the stop wall is disposed to permit passage of the debris from the rotating sweeping broom to the isolated debris lifting receptacle, to a debris stopping position temporally coincident with the raised debris dumping position and whereat the stop wall is disposed to stop the debris from the rotating sweeping broom.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

BRIEF DESCRIPTION OF THE DRAWINGS

The novel features which are believed to be characteristic of the debris lifting apparatus for use in a surface sweeping vehicle, according to the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF A PREFERRED EMBODIMENT

Figure 1:
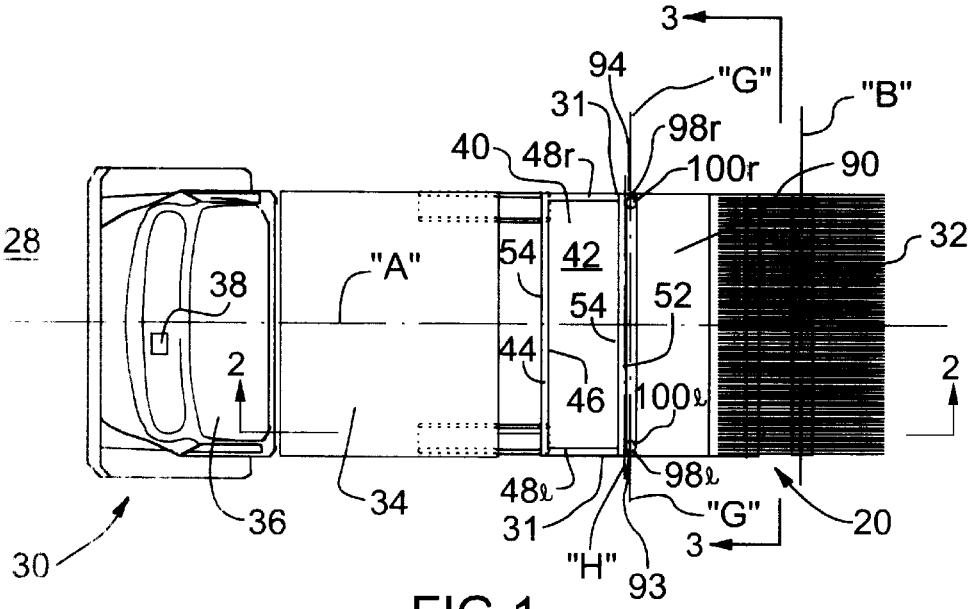
FIG. 1 is a top plan view of a surface sweeping vehicle including a preferred embodiment of the debris lifting apparatus according to the present invention, with some details omitted for the sake of clarity.

Referring to FIGS. 1 through 30B of the drawings, it will be noted that FIGS. 1 through 18 illustrate the preferred embodiment of the debris lifting apparatus according to the present invention, and FIGS. 19 through 31 illustrate various alternative embodiments of the debris lifting apparatus according to the present invention.

Reference will now be made to FIGS. 1 through 18 of the drawings, which show the preferred embodiment of the debris lifting apparatus, as indicated by the general reference numeral 20, of the present invention, for use in a surface sweeping vehicle, as indicated by the general reference numeral 30, such as a street sweeping vehicle or a factory sweeper. The surface sweeping vehicle 30 has a rotating sweeping broom 32, which in the preferred embodiment as illustrated, comprises an elongate drum-shaped sweeping broom mounted adjacent the rear of the surface sweeping vehicle 30 so as to be disposed laterally across a generally centrally disposed longitudinal axis "A", and mounted for rotation about a horizontal axis "B", as indicated by arrow "C" in FIG. 2, so as to sweep forwardly the dirt and debris on a surface 28, such as a road, factory floor, or the like. The debris is ultimately deposited into a hopper 34, as will be discussed in greater detail subsequently, for subsequent controlled dumping from the hopper 34.

The debris lifting apparatus 20 comprises an isolated debris lifting receptacle 40, which in turn comprises a substantially horizontally oriented floor 42 and a substantially vertically oriented back wall 44 adjoined to the floor 42 along a common vertex 46 between opposed left and right end walls 48*l*,48*r*. The floor 42 extends outwardly to a debris loading edge 52 and the back wall 44 extending upwardly to a top edge 54. A rubber sealing strip 55 extends along the debris loading edge 52, the purpose of which sealing strip 55 will be discussed in greater detail subsequently.

In the preferred embodiment, the substantially horizontally oriented floor 42 of the isolated debris lifting receptacle 40 further comprises an upwardly extending lip portion 56. Largely due to the upwardly extending lip portion 56, the floor 42 is concave upwardly so as to retain water and other liquid therein. Accordingly, the retained water and other liquid can be lifted to the hopper 34 along with other debris.

The isolated debris lifting receptacle 40 is operatively mounted on the surface sweeping vehicle 30 by a receptacle mounting means, the specifics of which will be discussed in greater detail subsequently, such that the isolated debris lifting receptacle 40 is disposed laterally across the generally centrally disposed longitudinal axis "A" and also such that the rotating sweeping broom 32 is disposed rearwardly of the isolated debris lifting receptacle 40. Accordingly, the rotating sweeping broom 32 propels debris forwardly into the isolated debris lifting receptacle 40.

Figure 2:
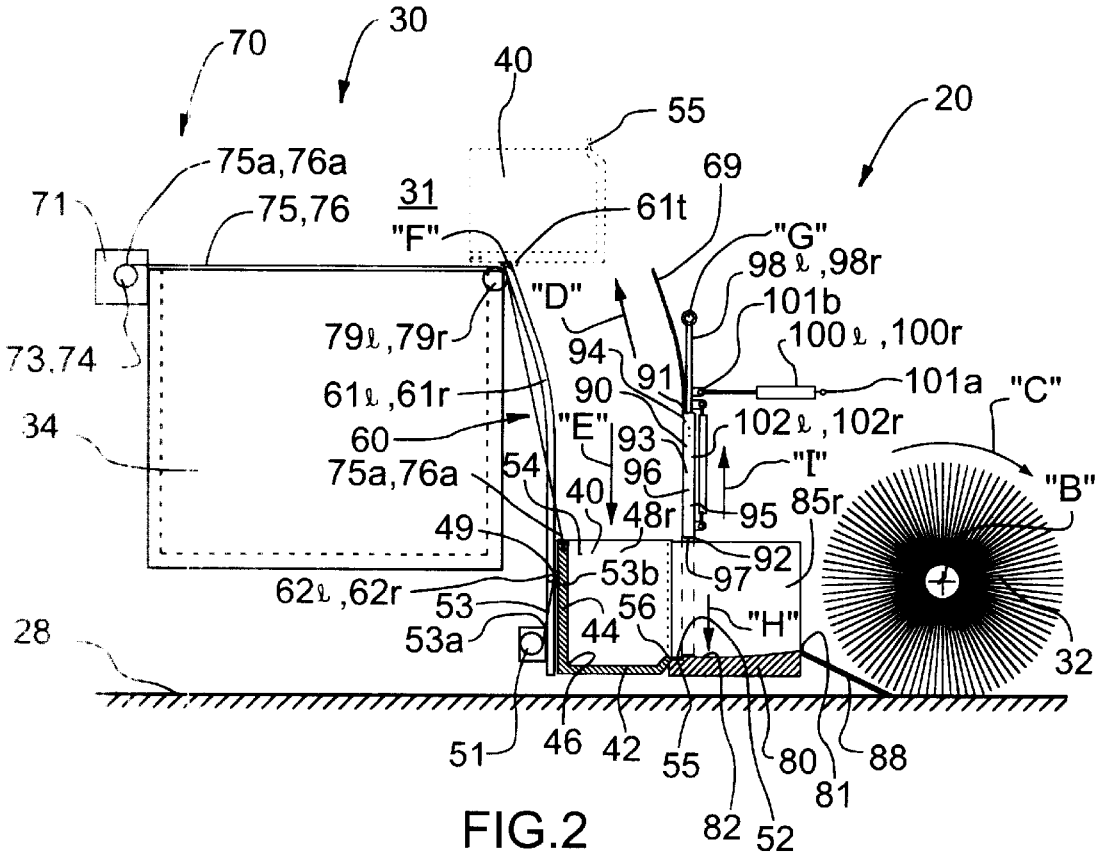
FIG. 2 is a sectional side elevational view of the surface sweeping vehicle and preferred embodiment debris lifting apparatus of FIG. 1, taken along section line 2—2, with a portion of the side of the surface sweeping vehicle removed for the sake of clarity.

The isolated debris lifting receptacle 40 is operatively mounted, as aforesaid, for arrested positioning in a lower debris receiving position, as shown in FIG. 2 in solid lining, and for positioning in a raised debris dumping position, as shown in FIG. 2 in ghost outline, and for travel between the lower debris receiving position and the raised debris dumping position, as indicated by arrows "D" and "E" in FIG. 2. In the lower debris receiving position, the isolated debris lifting receptacle 40 is disposed to receive and retain the debris propelled forwardly by the rotating sweeping broom 32. Preferably, but not necessarily, the arrested positioning is a paused positioning—that is to say that the isolated debris lifting receptacle 40 remains in the lower debris receiving position for a period of time as the debris propelled forwardly by the rotating sweeping broom 32 is received by the isolated debris lifting receptacle 40. For the purpose of the present invention, arrested positioning includes very minor movement, such as movement due to possible shock absorbing means within the receptacle mounting means, or similar, as long as the isolated debris lifting receptacle 40 remains in essentially the same position in order to receive debris.

Figure 11:
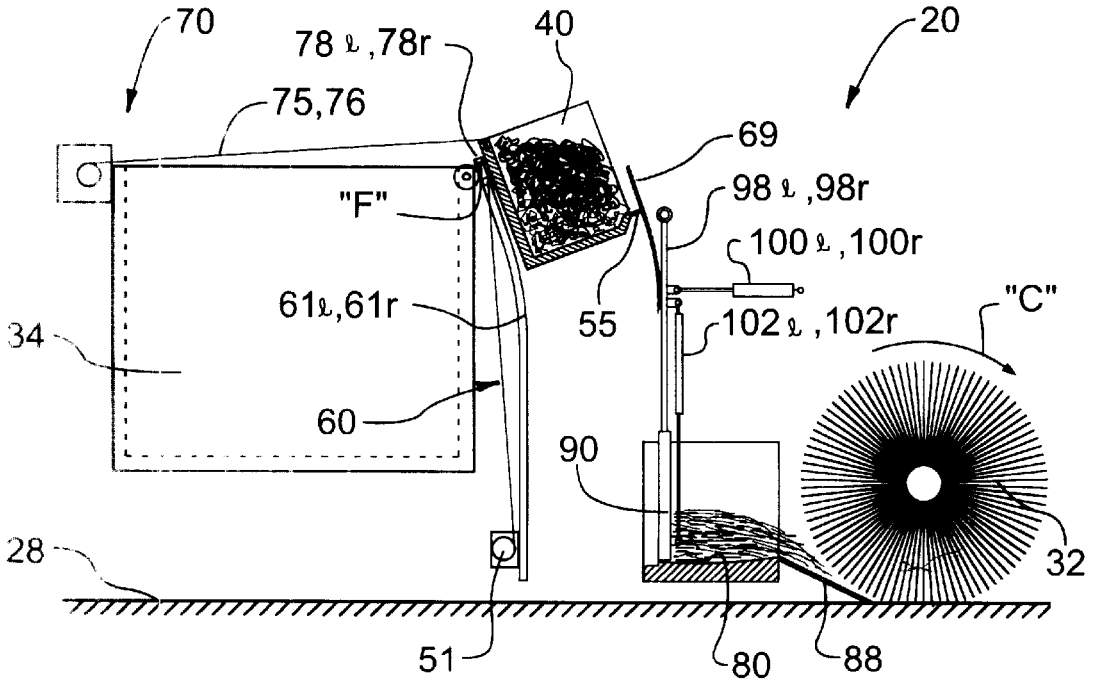
FIG. 11 is a sectional side elevational view similar to FIG. 10, with the isolated debris lifting receptacle in an elevated position, continuing to travel towards its raised debris dumping position.
Figure 12:
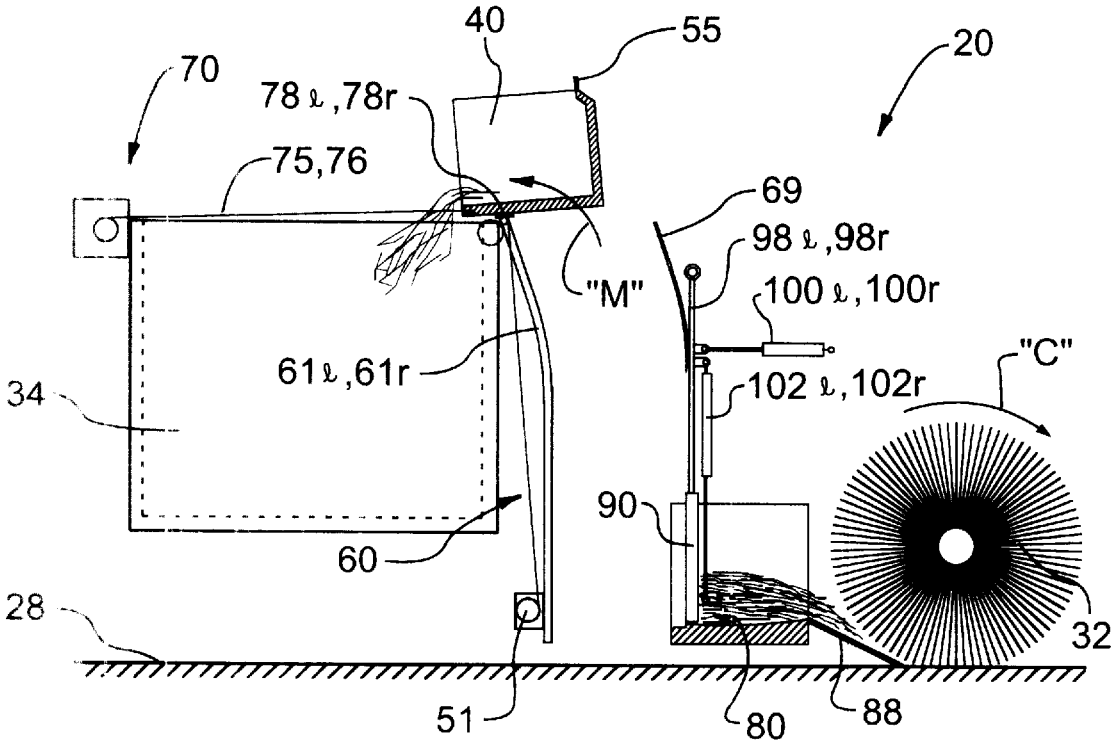
FIG. 12 is a sectional side elevational view similar to FIG. 11, with the isolated debris lifting receptacle in its raised debris dumping position, thereby dumping debris into the hopper.

In the raised debris dumping position, the isolated debris lifting receptacle 40 is appropriately positioned for the dumping of debris retained therein into the hopper 34. As discussed earlier, when the isolated debris lifting receptacle is in the raised debris dumping position, it can be rotated about axis "F" from its debris retaining orientation, as illustrated in FIG. 11, to its debris dumping orientation, as is illustrated in FIG. 12. The raised debris dumping position is preferably, but not necessarily, a paused positioning—that is to say that the isolated debris lifting receptacle 40 remains in the raised debris dumping position for a period of time sufficient to dump the debris retained within the isolated debris lifting receptacle 40 into the hopper 34. Although not specifically shown, the hopper 34 includes a lid, as do most conventional hoppers. Preferably, the lid is a cycling type of lid that opens automatically as the isolated debris lifting receptacle nears its debris dumping position, to permit the dumping of debris thereinto, and closes after the isolated debris lifting receptacle 40 leaves its debris dumping position.

In the preferred embodiment, as illustrated, the receptacle mounting means comprises a guide track means, as indicated by the general reference numeral 60, securely attached to the surface sweeping vehicle 30. The guide track means 60 comprises left and right guide tracks 61*l*,61*r* mounted in opposed facing relation one to the other. As can be best seen in FIG. 4, the left and right guide tracks 61*l*,61*r* are each operatively engaged in guiding relation with a co-operating first pilot member, as indicated by the general reference numerals 62*l*,62*r*. In the preferred embodiment, the first pilot members 62*l*,62*r* comprise wheels 63*l*,63*r* rotatably mounted on respective shaft members 64*l*,64*r* attached to the isolated debris lifting receptacle 40 by mounting lugs 65*l*,65*r*, respectively. The first pilot members 62*l*,62*r* act to guide the isolated debris lifting receptacle 40 in its the lower debris receiving position and the raised debris dumping position, and in travel therebetween. In this manner, the isolated debris lifting receptacle 40 travels along a single common path from the lower debris receiving position to the raised debris dumping position and back to the lower debris receiving position. As can be best seen in FIG. 2, stop members 78*l*,78*r* are disposed one in each of top ends 61*t* of the left and right guide tracks 61*l*,61*r*, which stop members preclude the first pilot members 62*l*,62*r* from coming out of the respective guide tracks 61*l*,61*r*.

As can be best seen in FIG. 2, the left and right guide tracks 61*l*,61*r* are vertically disposed at their bottom portions and curve upwardly therefrom to slanted upper portions, so as to fit around the rear wheels (not seen in FIG. 2) of the surface sweeping vehicle 30. Alternatively, the left and right guide tracks could be substantially vertically disposed, or could be slanted along their entire lengths.

Also, as can be best seen in FIG. 2, a spill precluding plate 69 is mounted on the surface sweeping vehicle 30 to extend from about half-way the left and right guide tracks 61*l*,61*r* to a distance above the top end 61*t* of the guide tracks 61*l*,61*r*, which distance is essentially the depth of the isolated debris lifting receptacle 40 □ or in other words, from the back wall 44 to the sealing strip 55. In any event, the spill-precluding plate 69 is shaped and positioned such that the rubber sealing strip 55 is substantially sealed contact with the spill-precluding plate 69 as the isolated debris lifting receptacle moves along the spill-precluding plate 69 when travelling between its debris receiving position and its debris dumping position. In this manner, debris is precluded from spilling out of the isolated debris lifting receptacle 40 during its travel along the spill-precluding plate 69.

Figure 3:
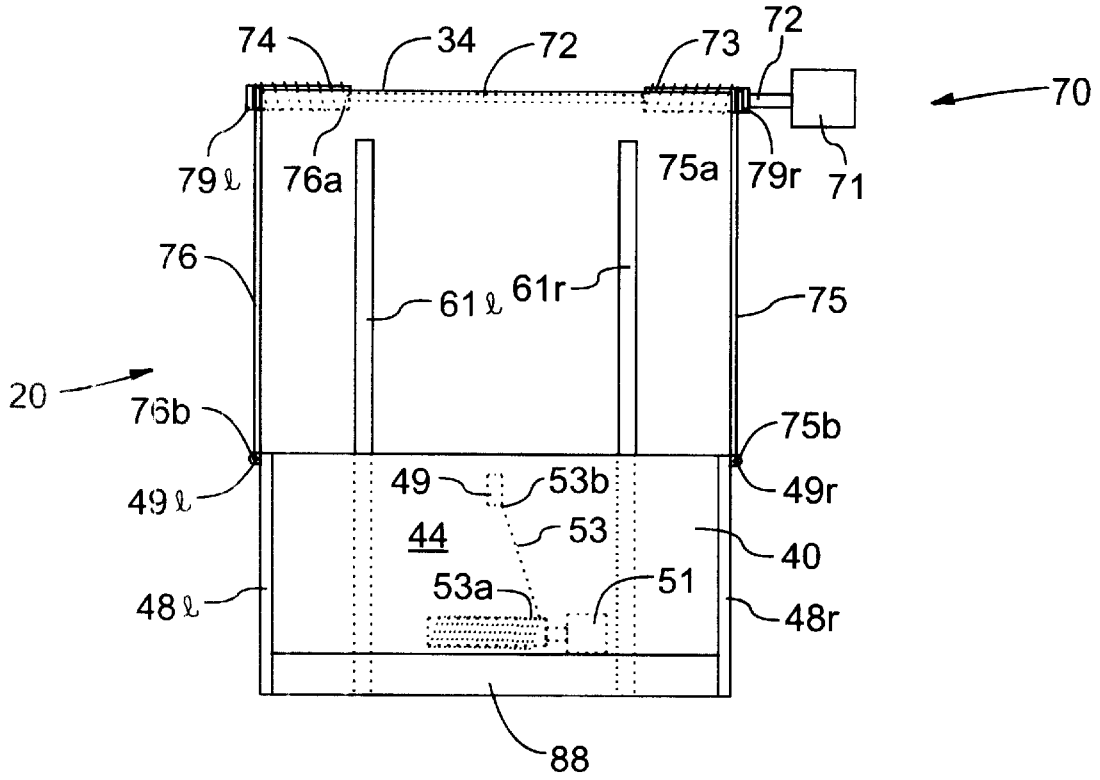
FIG. 3 is a sectional end elevational view of the surface sweeping vehicle and preferred embodiment debris lifting apparatus of FIG. 1, taken along section line 3—3, with some details omitted for the sake of clarity.
Figure 4:
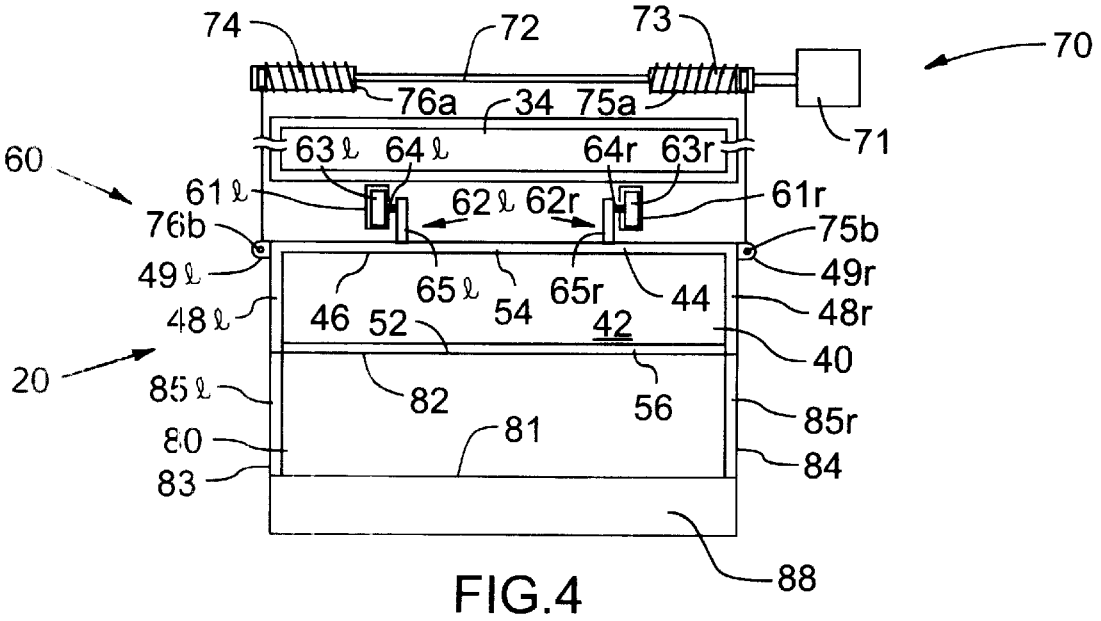
FIG. 4 is a top plan view of a portion of the surface sweeping vehicle and preferred embodiment debris lifting apparatus of FIG. 1, specifically showing the hopper, the isolated debris lifting receptacle, the guide track, and the debris receiving tray, with some details omitted for the sake of clarity.

A selectively operable drive means, as indicated by the general reference numeral 70, is mounted on the surface sweeping vehicle 30 and connected in driving relation to the isolated debris lifting receptacle 40 to effect movement of the isolated debris lifting receptacle 40 between the lower debris receiving position and the raised debris dumping position. In the preferred embodiment as illustrated, and as best seen in FIGS. 3 and 4, the selectively operable drive means comprises a first mechanical power device, specifically an electric motor 71. Alternatively, a hydraulic motor, or any other suitable motor, could be used. The electric motor 71 is mounted on the surface sweeping vehicle 30, a drive shaft 72 extending outwardly from the electric motor 71, a first spiral take-up reel 73 mounted in driven relation on the drive shaft 72 so as to be substantially aligned with the right end wall 48*r* of the isolated debris lifting receptacle 40, and a second take-up reel 74 mounted on the drive shaft 72 so as to be substantially aligned with the left end wall 481 of the isolated debris lifting receptacle 40. A first cable 75 is operatively retained in driven relation at one end 75*a* to the first take-up reel 73 is intermediately supported by a first idler wheel 79*r*, and is secured at its opposite other end 75*b* to a mounting tab 49*r* on the isolated debris lifting receptacle 40. Similarly, a second cable 76 is operatively retained in driven relation at one end 76*a* to the second take-up reel 74, is intermediately supported by a second idler wheel 791, and is secured at its opposite other end 76*b* to a mounting tab 491 on the isolated debris lifting receptacle 40. Essentially, the electric motor 71, the drive shaft 72, the first and second take up reels 73,74 and the first and second cables 75,76 constitute a uniformly pulling winch that can lift the isolated debris lifting receptacle 40 without binding in the left and right guide tracks 61*l*,61*r*.

In the preferred embodiment, there is also an electric motor 51, or alternatively a hydraulic motor, mounted on the surface sweeping vehicle 30 with a cable 53 operatively attached at one end 53*a* to the electric motor 51 and operatively attached at its opposite other end 53*b* to a mounting bracket 49 on the isolated debris lifting bucket 40. The electric motor 51 helps pull the isolated debris lifting bucket 40 from its raised debris dumping position to its lower debris receiving position.

The debris lifting apparatus 20 also comprises a dumping means, which in the preferred embodiment comprises the uniformly pulling winch and stop members 78*l*,78*r* disposed on the top ends of the left and right guide tracks 61*l*,61*r*, respectively. When the isolated debris lifting receptacle 40 reaches its raised debris dumping position, as can be seen in FIG. 11, the cables 75,76 continue to pull on the isolated debris lifting receptacle 40 so as to cause the isolated debris lifting receptacle 40 to be angularly displaceable about a substantially horizontal axis "F", from a debris retaining orientation, shown in FIG. 11, to a debris dumping orientation, shown in FIG. 12. In this manner, the uniformly pulling winch and the stop members 78*l*,78*r* effect dumping of the debris from the isolated debris lifting receptacle 40 into the hopper 34.

If desired, a vibrating mechanism (not shown) may be operatively mounted on the isolated debris lifting receptacle 40 to help dump the dirt and debris into the hopper 34.

The debris lifting apparatus 20 also comprises a debris receiving tray 80 defined by a debris ingress edge 81, a debris egress edge 82, a left side edge 83 and a right side edge 84. Preferably, the debris receiving tray 80 is concave from the debris ingress edge 81 to the debris egress edge 82, and comprises a left and right side walls 85*l*,85*r* so as to readily retain dirt and debris therein, and also to retain water and other liquid therein. The debris receiving tray 80 is mounted on the surface sweeping vehicle 30 between the rotating sweeping broom 32 and the isolated debris lifting receptacle 40, so as to receive debris swept forwardly by the rotating sweeping broom 32, when the sweeping broom 32 is in its raised debris dumping position, as will be discussed in greater detail subsequently. The debris receiving tray 80 is mounted so as to be vertically positioned, perhaps two to four inches above the surface being swept 28, to permit dirt and debris to pass therebetween.

The debris lifting apparatus 20 further comprises a deflector flap 88 mounted on the surface sweeping vehicle 30 and inclined to the debris ingress edge 81 of the debris receiving tray 80. The deflector flap 88 is positioned such that dirt and debris propelled forwardly by the rotating sweeping broom 32 are deflected upwardly past the debris ingress edge 81, with some of the debris falling onto the debris receiving tray 80, and with some of the debris travelling past the upwardly extending front lip portion 56 and into the isolated debris lifting receptacle 40. The deflector flap 88 is made from a rubber compound so as to be strong, yet flexible, in order to permit passage thereunder of any debris on a surface being swept.

The debris lifting apparatus 20 further comprises a stop wall 90 defined by a top edge 91, a bottom edge 92, a left side edge 93, and a right side edge 94, and having a debris impinging surface 95 and a receptacle facing surface 96. A rubber sealing strip 97 is disposed along the bottom edge 92 so as to make substantially sealed sliding contact with the debris receiving tray 80. The stop wall 90 is operatively mounted on the surface sweeping vehicle 30 for return movement from a debris passing position temporally coincident with the lower debris receiving position of the isolated debris lifting receptacle 40 and whereat the stop wall 90 is disposed to permit passage of the debris from the rotating sweeping broom 32 to the isolated debris lifting receptacle 40, to a debris stopping position temporally coincident with the raised debris dumping position and whereat the stop wall 90 is disposed to stop the debris from the rotating sweeping broom 32. When the stop wall 90 is in its debris passing position, the debris swept forwardly by the rotating sweeping broom 32 is received by the debris receiving tray 80 and the isolated debris lifting receptacle 40, and when the stop wall 90 is in its debris stopping position, the debris swept forwardly by the rotating sweeping broom 32 is stopped by the stop wall 90, so as to fall into the debris receiving tray 80.

In the preferred embodiment, as illustrated, the stop wall 90 is pivotally mounted on the surface sweeping vehicle 30 by means of a stop wall mounting means, for selective pivotal movement about a horizontally disposed stop wall pivot axis "G" between the debris passing position, as can be best seen in FIGS. 2, 7, 14 and 18, and the debris stopping position, as can be best seen in FIGS. 9 through 13 and 17. The stop wall mounting means comprises at least one lever arm, and preferably comprises left and right lever arms 98*l*,98*r*, which left and right lever arms 98*l*,98*r* are each pivotally mounted at their respective top ends 99*a* in the side walls 31 of the surface sweeping vehicle 30, generally in the area above the debris receiving tray 80 and the deflector flap 88, for reasons that will be discussed subsequently. The stop wall 90 is slidably mounted on the left and right lever arms 98*l*,98*r*.

Left and right primary hydraulically actuated piston mechanisms 100*l*,100*r*, are connected at one end 101*a* on the surface sweeping vehicle 30, typically on the walls 31, and are connected at the opposite other end 101*b* on the respective of the left and right lever arms 98*l*,98*r*. The left and right primary hydraulically actuated piston mechanisms 100*l*, 100*r*, are used to pivotally move the left and right lever arms 98*l*,98*r*, about the stop wall pivot axis "G". Alternatively, pneumatically actuated piston mechanisms can equivalently be used in place of the primary hydraulically actuated piston mechanisms 100*l*,100*r*.

Figure 5:
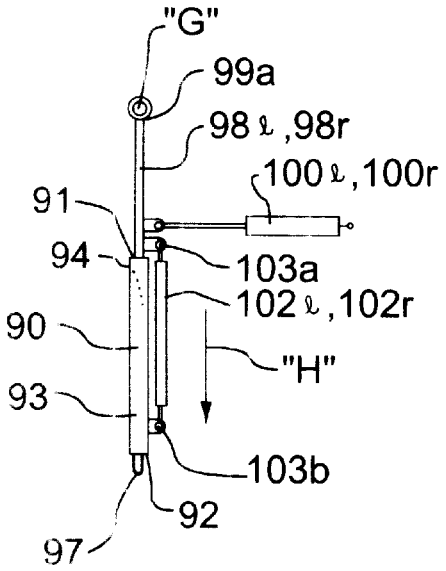
FIG. 5 is a side elevational view of the stop wall in a retracted configuration.
Figure 6:
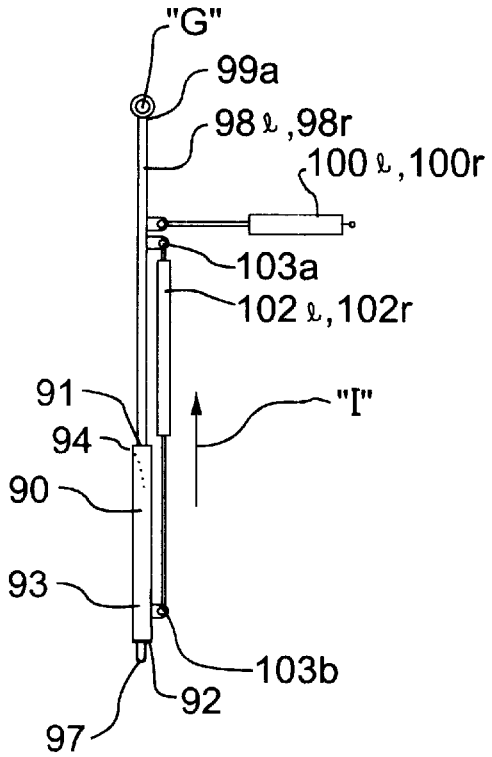
FIG. 6 is a side elevational view of the stop wall in an extended configuration.
Figure 7:
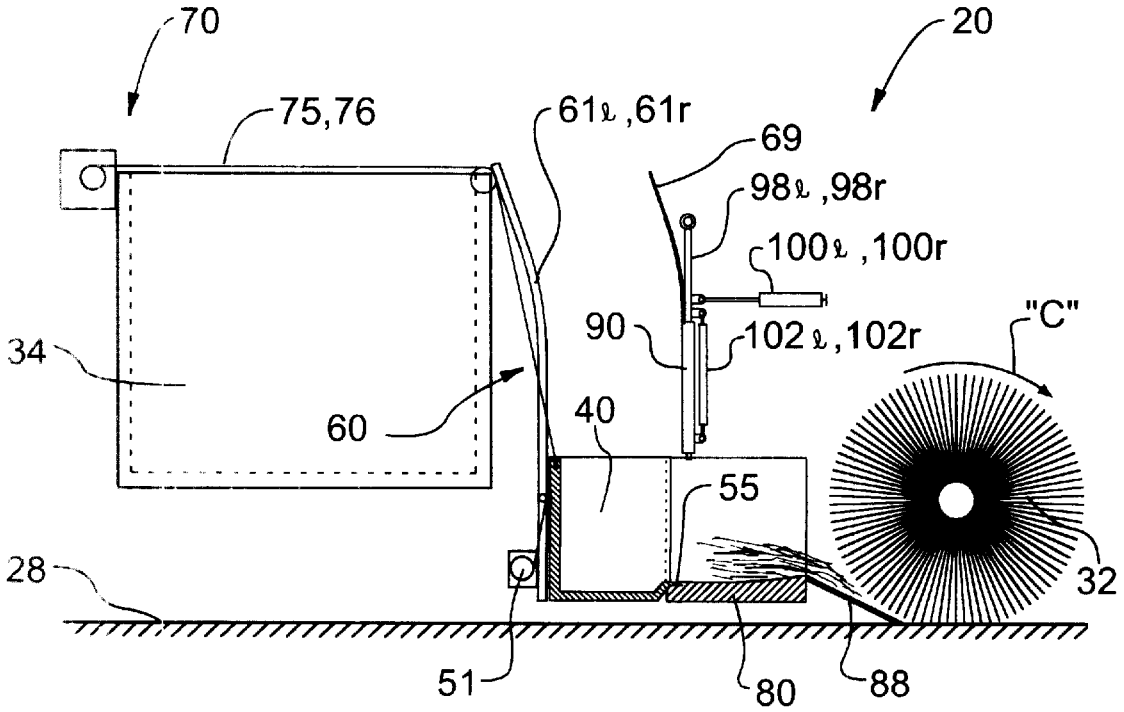
FIG. 7 is a sectional side elevational view similar to FIG. 2, but with the debris receiving tray also shown in section, and with the stop wall in a debris passing position and with the isolated debris lifting receptacle in its lower debris receiving position.
Figure 8:
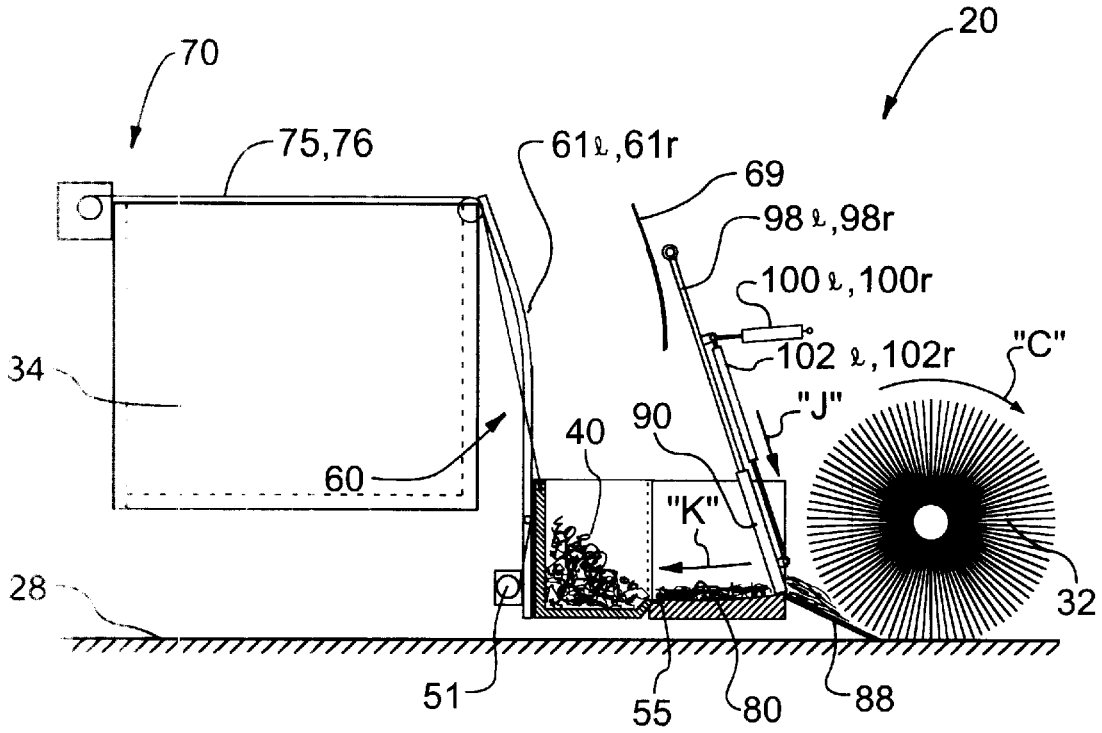
FIG. 8 is a sectional side elevational view similar to FIG. 7, with the stop wall having moved to its extended configuration and about to push debris along the debris receiving tray and into the isolated debris lifting receptacle.

Further, the stop wall 90 is slidably mounted on the left and right lever arms 98*l*,98*r*, for sliding movement as indicated by arrows H in FIGS. 2 and 5 and arrows "I" in FIGS. 2 and 6, between a retracted configuration, as can be best seen in FIG. 5, and an extended configuration, as can be best seen in FIG. 6. The up and down vertical movement of the stop wall 90 is effected by left and right secondary hydraulically actuated piston mechanisms 102*l*,102*r* having one end 103*a* mounted on one of the left and right lever arms 98*l*,98*r*, and the opposite other end 103*b* mounted on the stop wall 90. In the extended configuration the stop wall 90 is appropriately oriented to act as a stop wall while in the retracted configuration the stop wall 90 is not oriented to act as a stop wall, but permits the passage of debris from the rotating sweeping broom 32 to the isolated debris lifting receptacle 40 and may also deflect some dirt and debris towards the isolated debris lifting receptacle 40.

Figure 9:
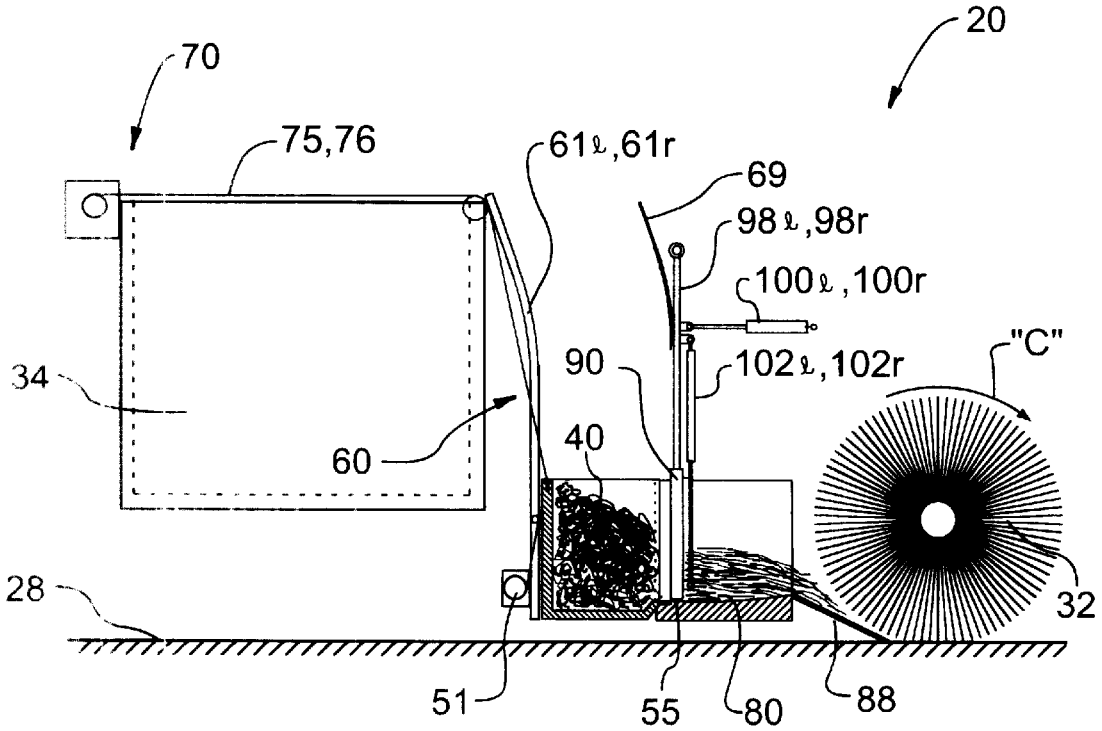
FIG. 9 is a sectional side elevational view similar to FIG. 8, with the stop wall in its debris stopping position, having pushed debris along the debris receiving tray and into the isolated debris lifting receptacle.
Figure 10:
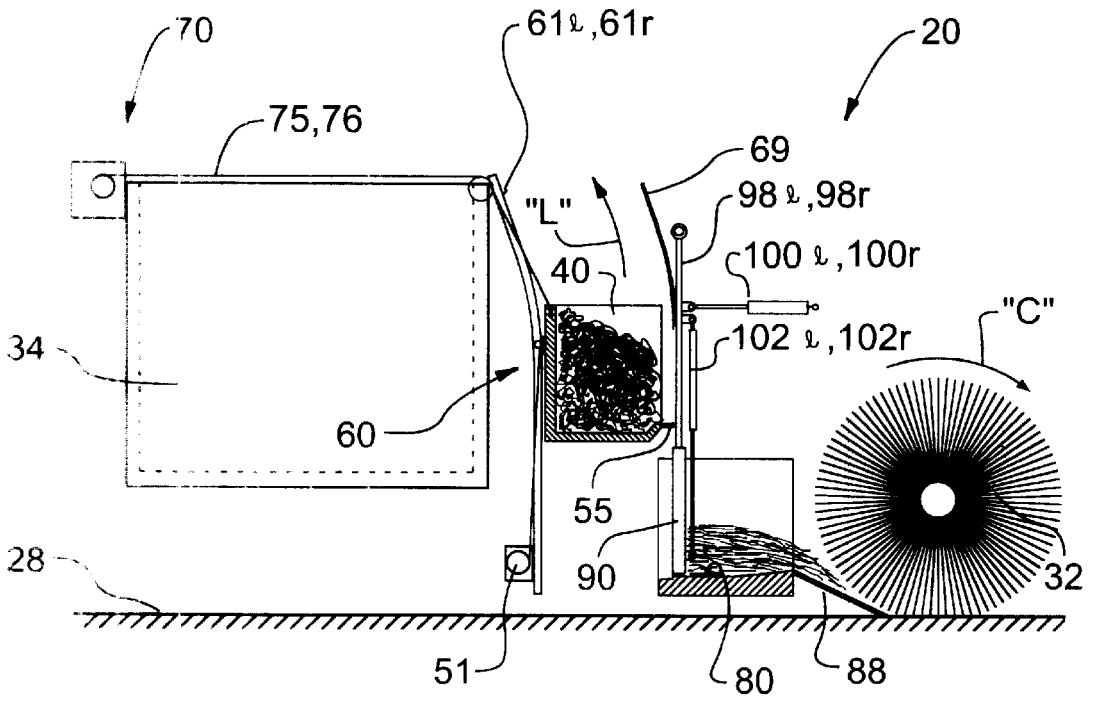
FIG. 10 is a sectional side elevational view similar to FIG. 9, with the isolated debris lifting receptacle moving upwardly along left and right guide tracks.

As can be best seen in FIGS. 9 and 10, the debris stopping position of the stop wall 90 is selected to permit the sealing strip 55 on the debris loading edge 52 of the isolated debris lifting receptacle 40 to contact the receptacle facing surface 96 of the stop wall 90 in substantially sealed relation, so as to preclude debris in the isolated debris lifting receptacle from falling out as it is lifted from its debris receiving position toward its debris dumping position. Such moving contact of the sealing strip 55 along the receptacle facing surface 96 of the stop wall 90 also acts to clean the receptacle facing surface 96.

It can also be seen that as the rubber sealing strip 97 wears down, the vertical position of the stop wall 90 can be automatically adjusted by the left and right secondary hydraulically actuated piston mechanisms 102*l*,*r*.

In use, as can be best seen in FIGS. 1 through 5 and 7 through 9, the isolated debris lifting receptacle 40 is arrestedly positioned in its lower debris receiving position, whereat the isolated debris lifting receptacle 40 is disposed to receive and retain the debris propelled forwardly by the rotating sweeping broom 32. As can be best seen in FIG. 7, the stop wall 90 is in its debris passing position and in its retracted configuration, thus allowing the rotating sweeping broom 32 to propel debris forwardly into the isolated debris lifting receptacle 40. When the isolated debris lifting receptacle 40 is full, as can be best seen in FIG. 8, the stop wall 90 is moved by the left and right lever arms 98*l*,98*r*, to its extended configuration, as indicated by arrow "J", and positioned at the debris ingress edge of the debris receiving tray 80. It is then pivotally moved about the first horizontal pivot axis "G" by the left and right primary hydraulically actuated piston mechanisms, as indicated by arrow "K", such that the stop wall 90 moves in surface contacting relation across the debris receiving tray 80, to the debris egress edge 82 of the debris receiving tray 80 as can be best seen in FIG. 9, so as to push debris along the debris receiving tray 80 and into the isolated debris lifting receptacle 40. The stop wall 90 remains in its debris stopping position, as can be best seen in FIGS. 10–13, while the isolated debris lifting receptacle 40 is lifted, as indicated by arrow "L" in FIG. 10, from its debris receiving position, as can be best seen in FIG. 9, through a partially raised position, as can be best seen in FIG. 10 through a substantially raised portion, as can be best seen in FIG. 11, and to its debris dumping position, as can be best seen in FIG. 12. After the isolated debris lifting receptacle 40 has reached the substantially raised position of FIG. 11, it is angularly displaceable about its substantially horizontal axis "F", as discussed above, and as indicated by arrow "M" in FIG. 12, from a debris retaining orientation shown in FIG. 11, to a debris dumping orientation shown in FIG. 12.

Figure 13:
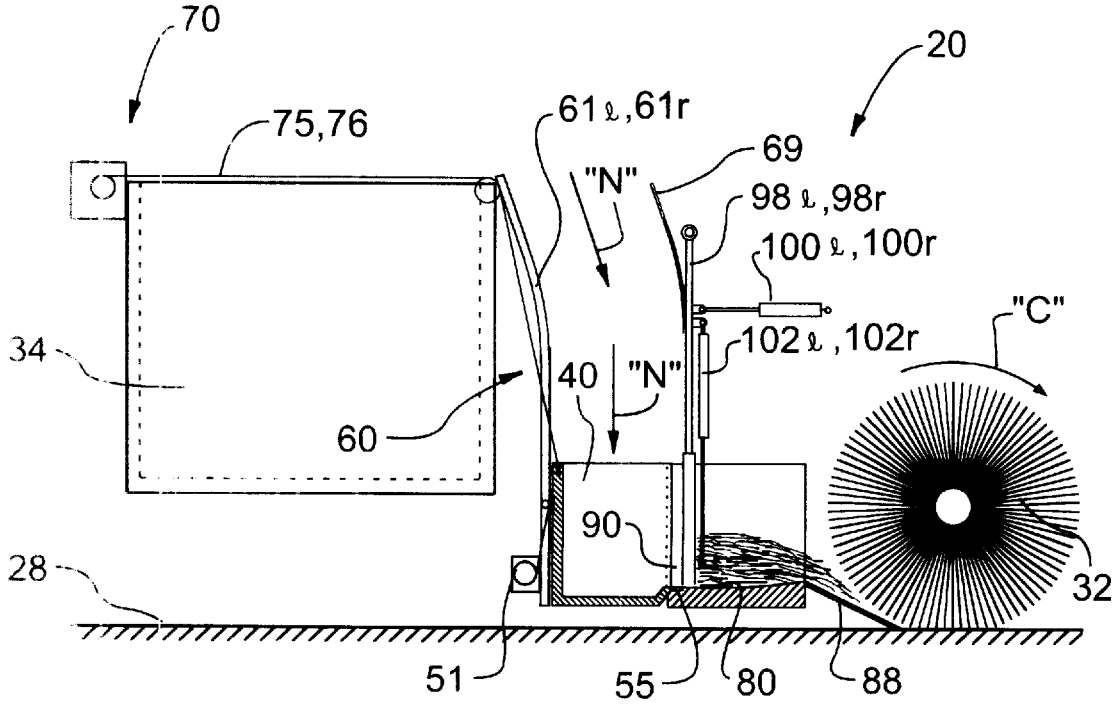
FIG. 13 is a sectional side elevational view similar to FIG. 12, with the isolated debris lifting receptacle having returned to its lower debris receiving position.
Figure 14:
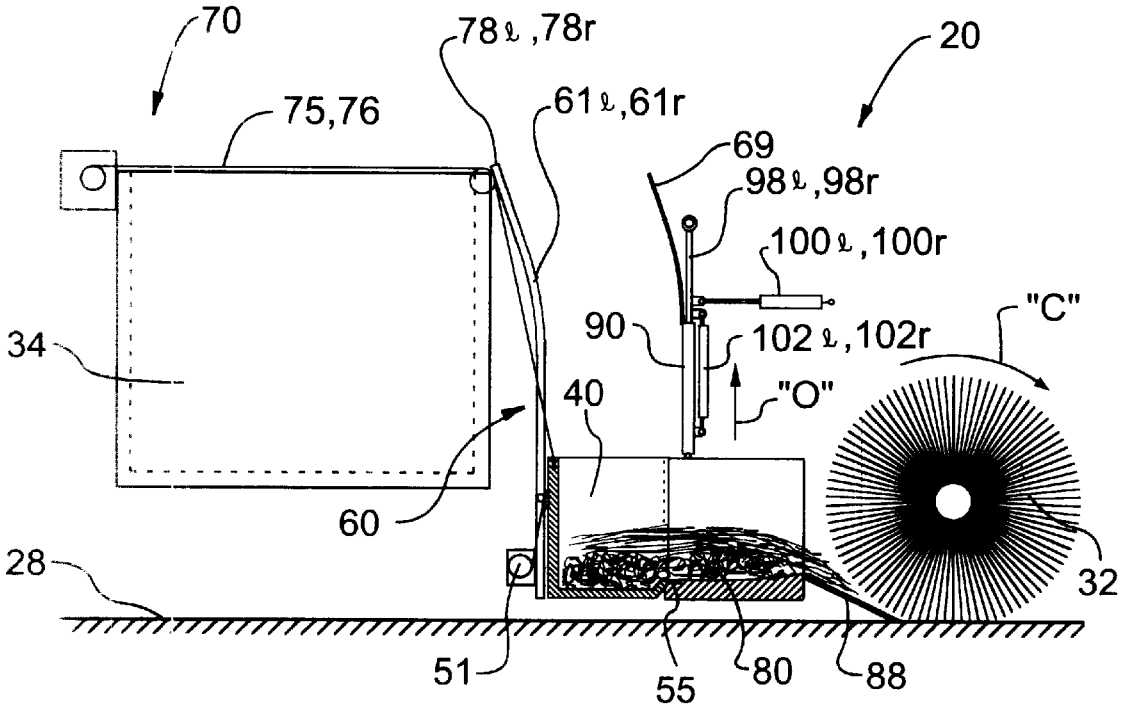
FIG. 14 is a sectional side elevational view similar to FIG. 13, with the isolated debris lifting receptacle in its lower debris receiving position and with the stop wall having been moved to its retracted configuration, and thereby being in its debris passing position.
Figure 15:
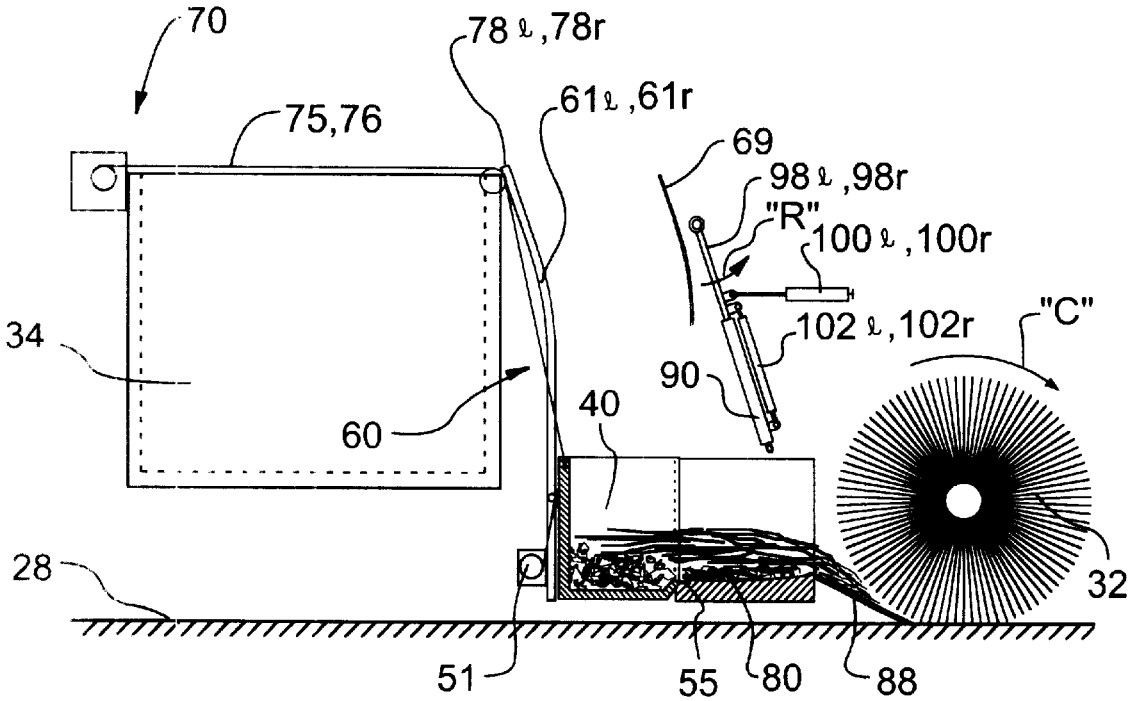
FIG. 15 is a sectional side elevational view similar to FIG. 14, with the stop wall having been moved rearwardly.
Figure 16:
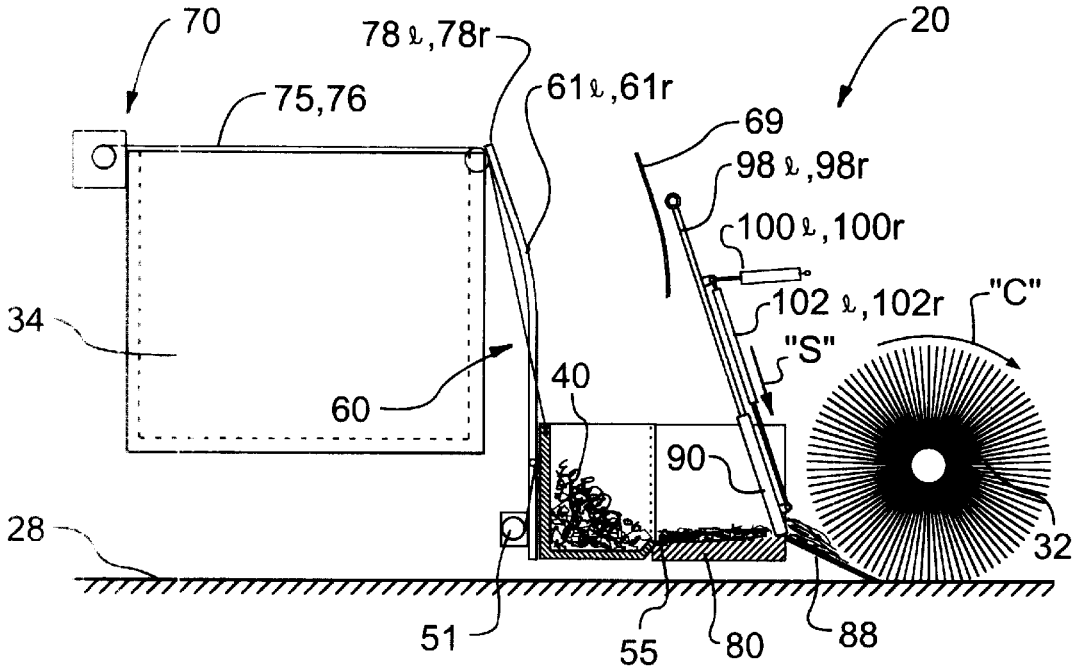
FIG. 16 is a sectional side elevational view similar to FIG. 15, with the stop wall again in its extended configuration and with the stop wall again about to push debris along the debris receiving tray and into the isolated debris lifting receptacle.
Figure 17:
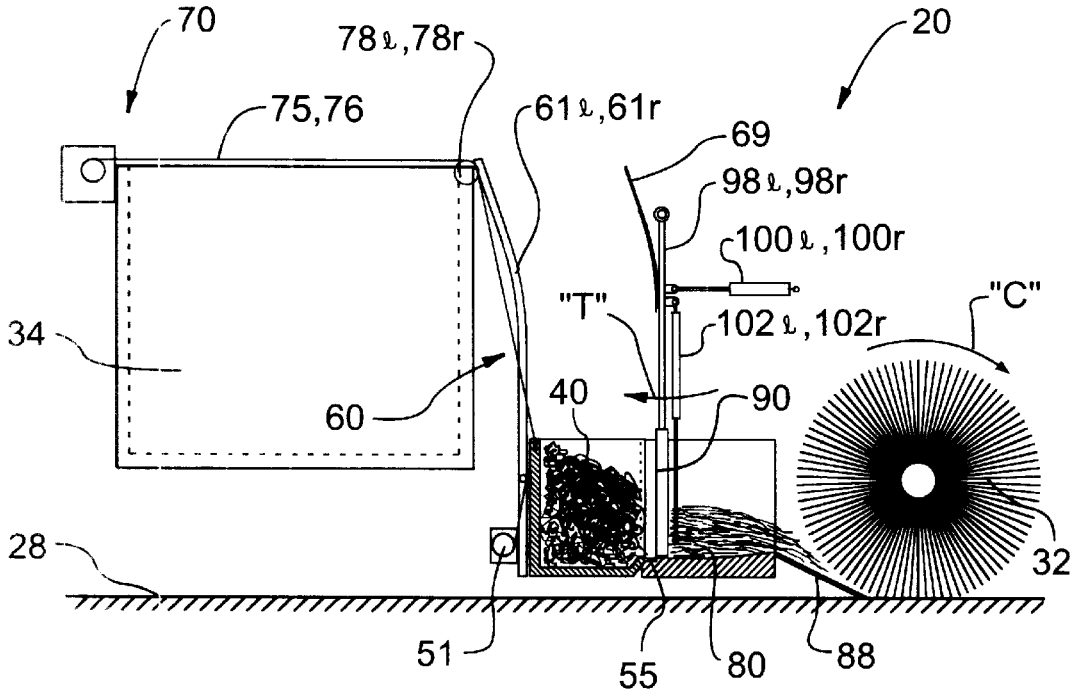
FIG. 17 is a sectional side elevational view similar to FIG. 16, with the stop wall again in its debris stopping position, having pushed debris along the debris receiving tray and into the isolated debris lifting receptacle.
Figure 18:
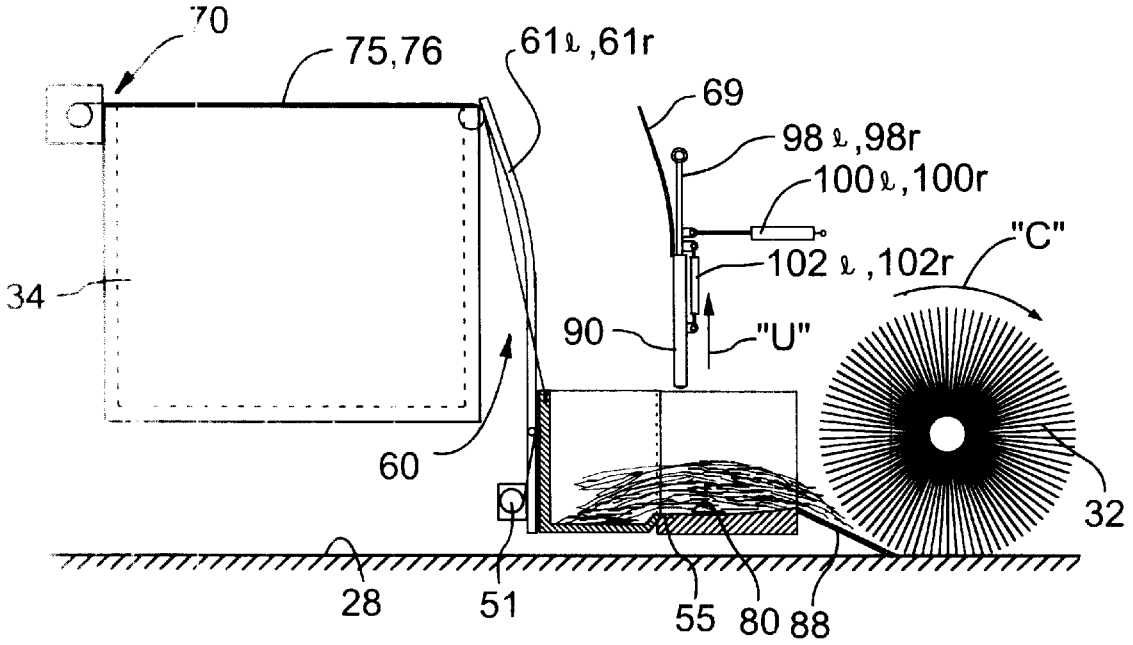
FIG. 18 is a sectional side elevational view similar to FIG. 17, with the stop wall having been moved to its retracted configuration again which corresponds to its debris passing position.

After the isolated debris lifting receptacle 40 returns to its debris receiving position, as indicated by arrows "N" in FIG. 13, the stop wall 90 is moved to its retracted configuration, as indicated by arrow "O" in FIG. 14, and is next pivoted about the first horizontal pivot axis "G" towards the rotating sweeping broom 32, as indicated by arrow "R" in FIG. 15. The stop wall 90 is then moved, as indicated by arrow "S" in FIG. 16, to its extended configuration, so as to be again positioned at the debris ingress edge of the debris receiving tray 80. Debris that has accumulated in the debris receiving tray 80 while the isolated debris lifting receptacle 40 has travelled from its debris receiving position to its debris dumping position and back to its debris receiving position, is pushed by movement of the stop wall 90, as indicated by arrow "T" in FIG. 17, along the debris receiving tray 80 and into the isolated debris lifting receptacle 40, until the stop wall 90 is at the debris egress edge 82 of the debris receiving tray 80, as can be best seen in FIG. 17. The stop wall 90 then returns to its debris passing position, as indicated by arrow "U" in FIG. 18.

It can be seen that when the isolated debris lifting receptacle 40 is not in its debris receiving position, or in other words is in its debris dumping position, or moving to or from its debris dumping position, the stop wall 90 is in its debris stopping position. Accordingly, the debris swept forwardly by the rotating sweeping broom 32 during this time is stopped by the stop wall 90 and accumulates on the debris receiving tray 80. This accumulated debris is ultimately pushed into the isolated debris lifting receptacle 40. In this manner, the debris propelled forwardly by the rotating sweeping broom 32 is continuously captured and subsequently loaded into the hopper 34.

In the preferred embodiment, the movement of the stop wall 90 from the debris passing position to the debris stopping position, so as to push the debris along the debris receiving tray 80 and into the isolated debris lifting receptacle 40, and back again, as aforesaid, follows an aperiodic cycle, irrespective of whether the stop wall 90 performs the task of pushing debris from the debris receiving tray 80 and into the isolated debris lifting receptacle 40 immediately before the isolated debris lifting receptacle 40 moves from its lower debris receiving position to its raised debris dumping position, or not. In other words, the duration of the cycle is not pre-set. Rather, the duration of each aperiodic cycle is automatically adjustable according to an external parameter, specifically according to the weight of the debris in the isolated debris lifting receptacle 40. The predetermined weight value is adjusted by means of a manually operable control switch 38 in the cab 36 of the surface sweeping vehicle 30.

Figure 19:
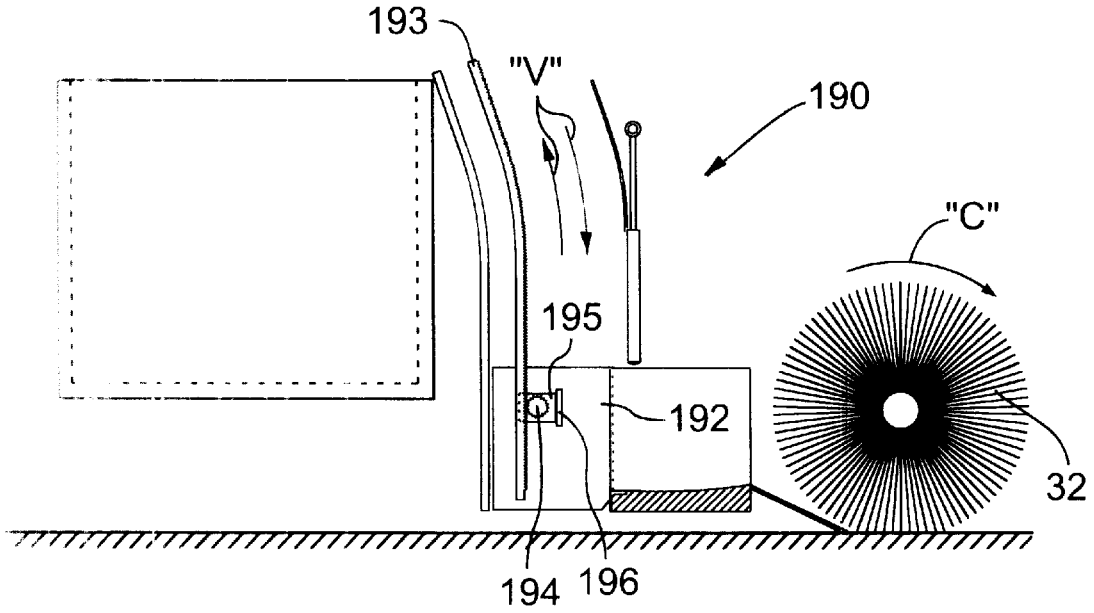
FIG. 19 is a sectional side elevational view similar to FIG. 2, but of a first alternative embodiment of the debris lifting apparatus according to the present invention.

A first alternative embodiment of the debris lifting apparatus according to the present invention, as indicated by the general reference numeral 190, is illustrated in FIG. 19, wherein guide tracks 191 for the isolated debris lifting receptacle 192 further comprise a toothed rail 193 and the drive means comprises a drive gear 194 operatively engaging the toothed rail 193. The drive gear 194 is driven by a reversible mechanical power device, specifically an electrically powered motor 195, or any other suitable type of motor, mounted on a mounting plate 196 secured to the isolated debris lifting receptacle 192. The isolated debris lifting receptacle 192 is operatively mounted on guide tracks 191, as described in the preferred embodiment, and is movable bi-directionally along the toothed rail 193 by the drive gear 194 and the motor 195, as indicated by arrows "V".

Figure 20:
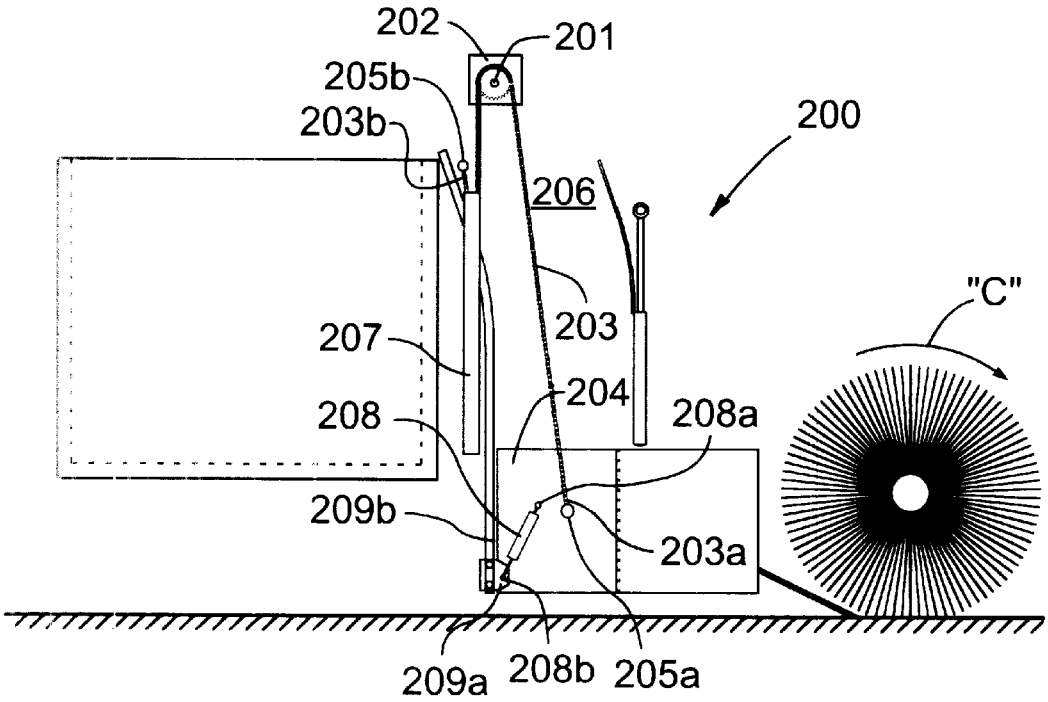
FIG. 20 is a sectional side elevational view similar to FIG. 2, but of a second alternative embodiment of the debris lifting apparatus according to the present invention.

A second alternative embodiment of the debris lifting apparatus according to the present invention, as indicated by the general reference numeral 200, is illustrated in FIG. 20. The drive means comprises a drive sprocket 201 driven by a reversible mechanical power device, specifically an electrically powered motor 202, or any other suitable type of motor, and the receptacle mounting means comprises a drive chain 203 looped around the drive sprocket 201, anchored at its first end 203*a* to the isolated debris lifting receptacle 204 by a threaded stud 205*a* and anchored at its second end 203*b* to the surface sweeping vehicle 206 by a threaded stud 205*b*. As the isolated debris lifting receptacle 204 is lifted, the drive chain 203 falls into a protective container 207 to preclude the drive chain 203 from becoming entangled in any other parts. A tip cylinder 208 is secured at its first end 208*a* on the isolated debris lifting receptacle 204 and secured at its opposite other end 208*b* on a trolley mechanism 209*a* engaged in the track member 209*b*.

Figure 21:
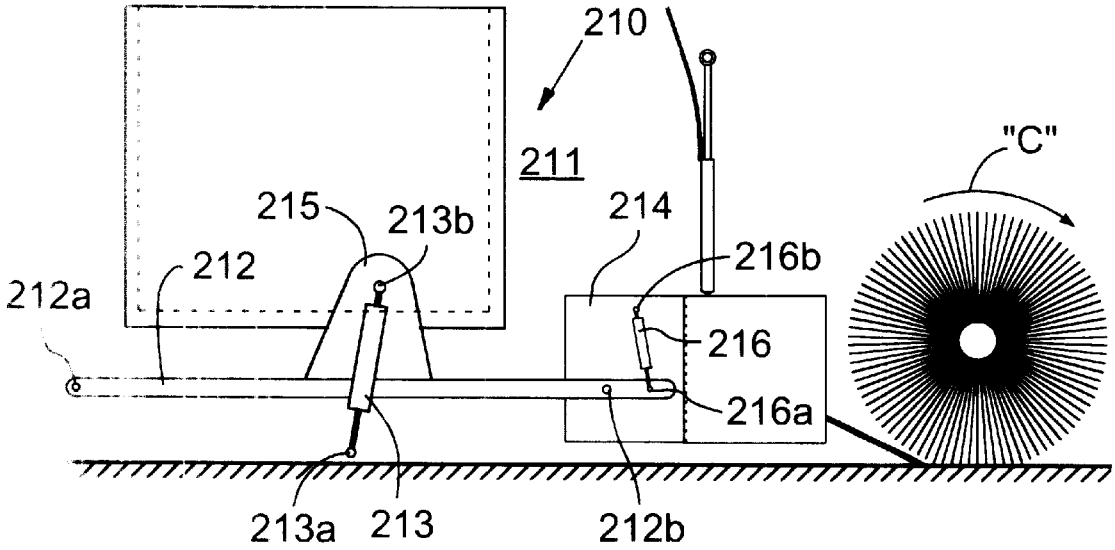
FIG. 21 is a sectional side elevational view similar to FIG. 2, but of a third alternative embodiment of the debris lifting apparatus according to the present invention.

A third alternative embodiment of the debris lifting apparatus according to the present invention, as indicated by the general reference numeral 210, in a surface sweeping vehicle 211, is illustrated in FIG. 21. The receptacle mounting means comprises at least one lever arm 212 pivotally mounted on the surface sweeping vehicle 211 at 212*a* and pivotally mounted to the isolated debris lifting receptacle 214 at 212*b*. The drive means comprises a hydraulically or pneumatically actuated piston mechanism 213 connected at one end 213*a* to the surface sweeping vehicle 211 and connected at its opposite other end 213*b* to a mounting plate 215 extending upwardly from the lever arm 212. The isolated debris lifting receptacle 214 is rotated about 212*b* from its debris retaining orientation by means of a hydraulically or pneumatically actuated piston mechanism 216 mounted at one end 216*a* to the lever arm 212 and at its opposite other end 216*b* to the debris lifting receptacle 214.

Figure 22:
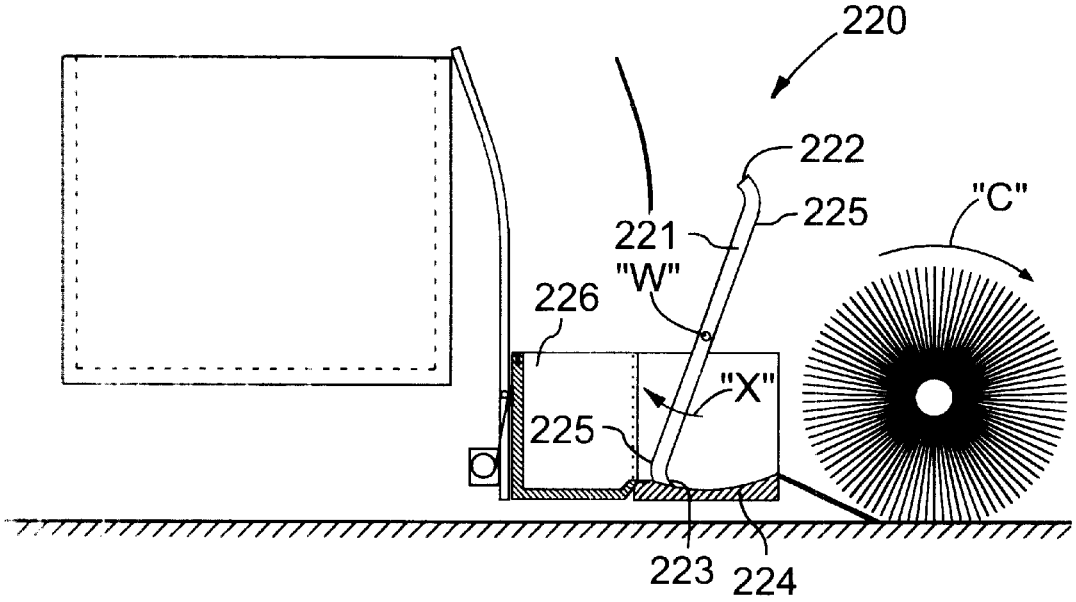
FIG. 22 is a sectional enlarged side elevational view similar to FIG. 2, but of a fourth alternative embodiment of the debris lifting apparatus according to the present invention.
Figure 23:
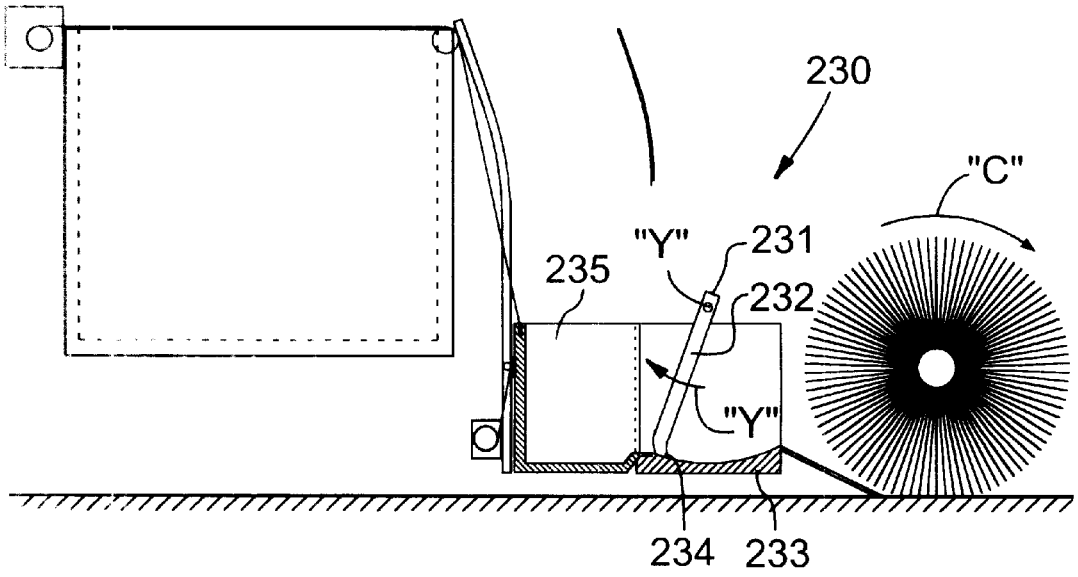
FIG. 23 is a sectional side elevational view similar to FIG. 3, but of a fifth alternative embodiment of the debris lifting apparatus according to the present invention.

A fourth alternative embodiment of the debris lifting apparatus according to the present invention, as indicated by the general reference numeral 220, is illustrated in FIG. 22. The alternative embodiment stop wall 221 has its first horizontal pivot axis "W" disposed centrally between the first horizontal edge 222 and the second horizontal edge 223 of the stop wall 221. In use, the stop wall 220 rotates about this first horizontal pivot axis "W", as indicated by arrow "X" to move debris along the debris receiving tray 224. The stop wall 221 is curved near each of its top and bottom edges 222, 223 such that the receptacle facing surface 225 is convexly curved, thus precluding the stop wall 221 from scooping up debris from the debris receiving tray 224 and the isolated debris lifting receptacle 226 after pushing debris forward. Similarly, but slightly differently, in a fifth alternative embodiment of the debris lifting apparatus according to the present invention, as indicated by the general reference numeral 230, as illustrated in FIG. 23, the first horizontal pivot axis "Y" is disposed adjacent the edge 231 of the stop wall 232, and in use, the stop wall 232 rotates about this first horizontal pivot axis "Y", as indicated by arrow "Z", to move debris along the debris receiving tray 233. Again, the stop wall 232 is curved near its bottom edge 234 so as to preclude scooping up debris from the debris receiving tray 233 and the isolated debris lifting receptacle 235 after pushing debris forwardly.

Figure 24:
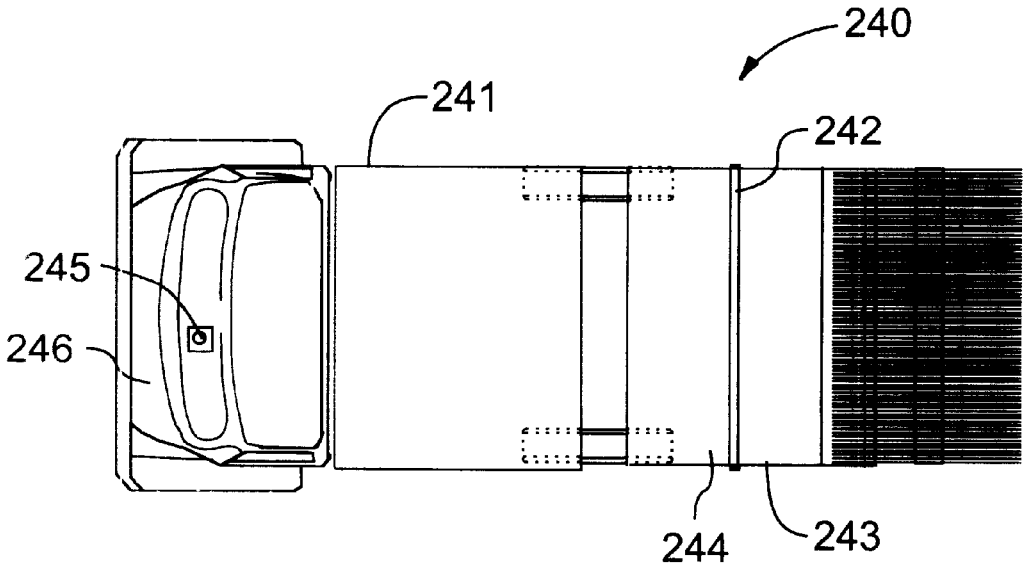
FIG. 24 is a top plan view of a surface sweeping vehicle including a sixth alternative embodiment of the debris lifting apparatus according to the present invention.

A sixth alternative embodiment of the debris lifting apparatus according to the present invention, as indicated by the general reference numeral 240, in a surface sweeping vehicle 241, is illustrated in FIG. 24. The movement of the stop wall 242 from the debris passing position to the debris stopping position, so as to push the debris up the deflector flap 243 and into the isolated debris lifting receptacle 244, as aforesaid, follows a periodic cycle. The periodic cycle is selectably adjustable in duration, at the discretion of an operator, by means of a manually adjustable timer 245 located in the cab 246 of the surface sweeping vehicle 241.

Figure 25:
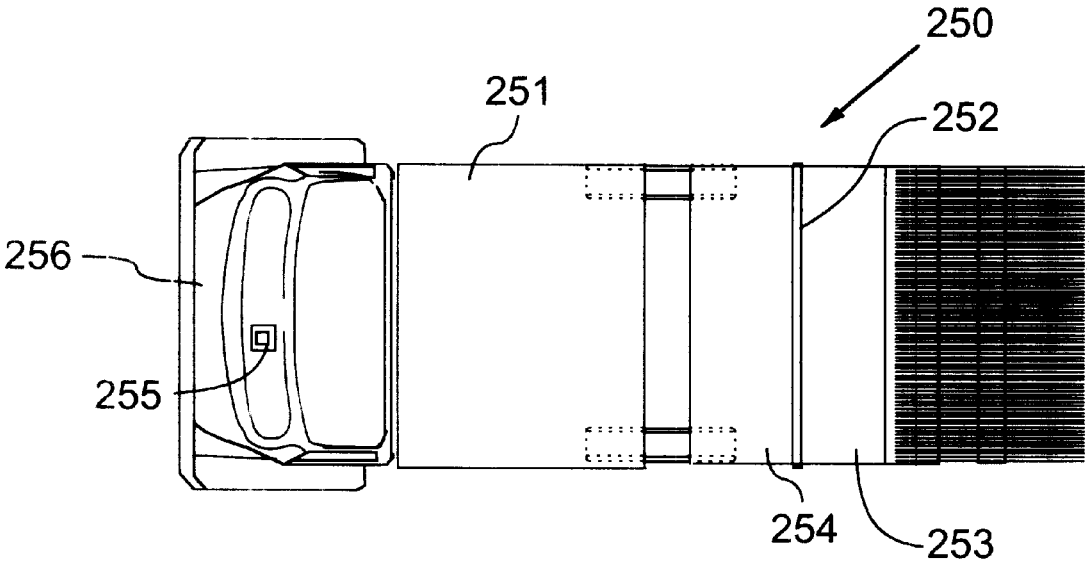
FIG. 25 is a top plan view of a surface sweeping vehicle including an seventh alternative embodiment of the debris lifting apparatus according to the present invention.

Similarly, in an seventh alternative embodiment of the debris lifting apparatus according to the present invention, as indicated by the general reference numeral 250, in a surface sweeping vehicle 251, as is shown in FIG. 25, the movement of the stop wall 252 from the debris passing position to the debris stopping position, so as to push the debris up the deflector flap 253 and into the isolated debris lifting receptacle 254, as aforesaid, is selectably commenced, at the discretion of an operator, by means of a manually operable switch 255 located in the cab 256 of the surface sweeping vehicle 251.

Figure 26:
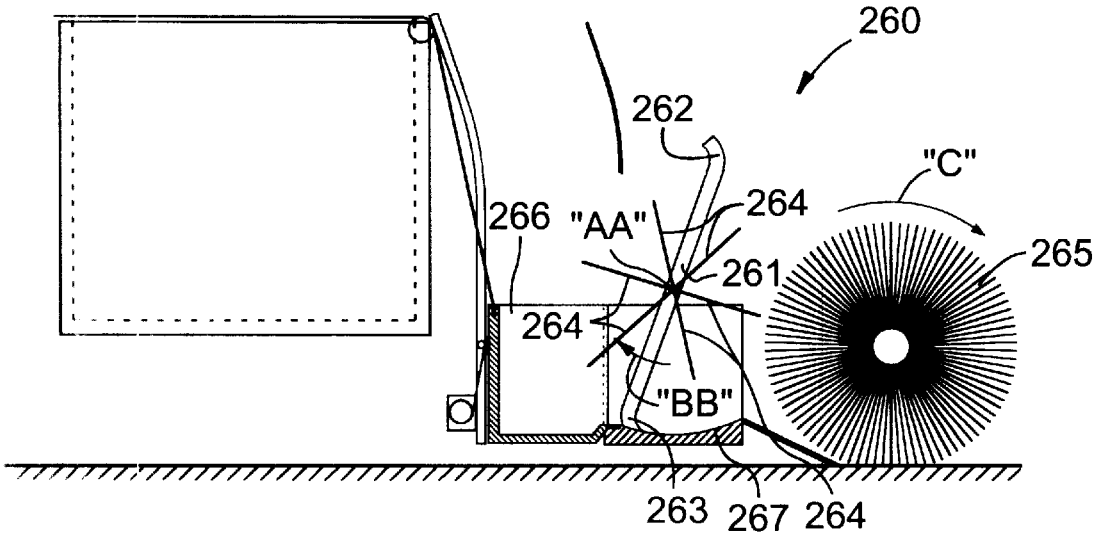
FIG. 26 is a sectional side elevational view including an eighth alternative embodiment of the debris lifting apparatus according to the present invention.

In yet another alternative embodiment of the debris lifting apparatus according to the present invention, as indicated by the general reference numeral 260, specifically the eighth alternative embodiment as illustrated in FIG. 26, the selective pivotal movement of the stop wall 261 about the first horizontal pivot axis "AA" occurs in a first rotational direction, as indicated by arrow "BB", from the debris passing position to the debris stopping position, and in the same first rotational direction from the debris stopping position to the debris passing position. The stop wall 261, as illustrated, comprises two oppositely directed paddle portions 262,263 used to stop the debris when in the debris stopping position and to push the debris along the debris receiving tray 267, and a plurality of radially outwardly directed fingers 264 used to help move large pieces of debris, such as tire treads, and so on, from the sweeping broom 265 ultimately to the isolated debris lifting receptacle 266. The two oppositely directed paddle portions 262, 263 are curved so as to preclude scooping up debris from the debris receiving tray 267 and the isolated debris lifting receptacle 266.

Figure 27:
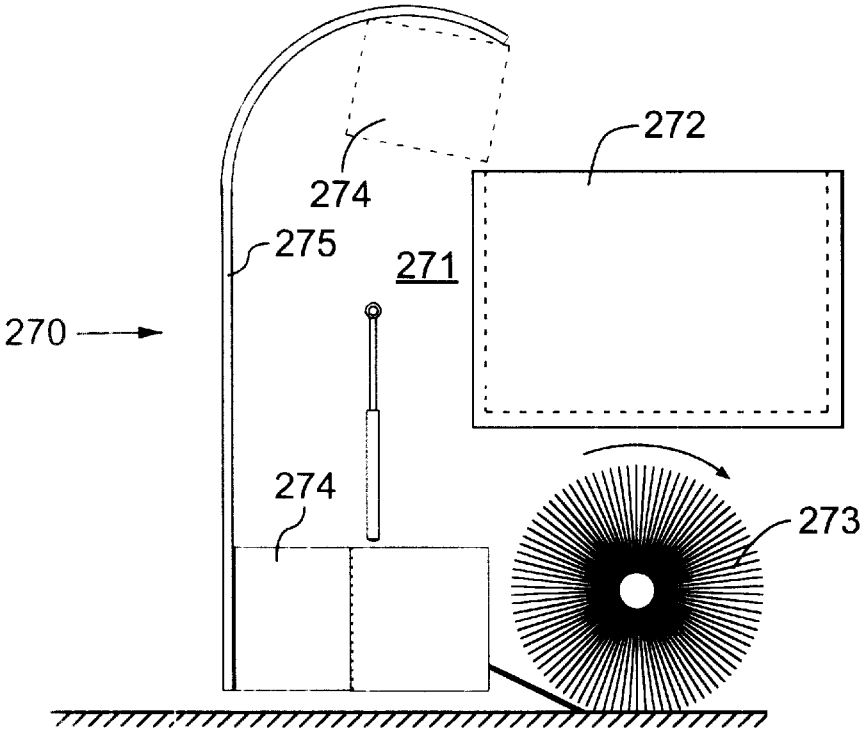
FIG. 27 is a sectional side elevational view including a ninth alternative embodiment of the debris lifting apparatus according to the present invention.

In yet another alternative embodiment of the debris lifting apparatus according to the present invention, as indicated by the general reference numeral 270 in a surface sweeping vehicle 271, specifically the ninth alternative embodiment as illustrated in FIG. 27, the hopper 272 is disposed over the sweeping broom 273. The isolated debris lifting receptacle 274 is mounted for movement along the guide track 275 between a lower debris receiving position and a raised debris dumping position in the same manner as is described above for the preferred embodiment, or any other suitable means, and is moved by between the lower debris receiving position and a raised debris dumping position in the same manner as is described above for the preferred embodiment, or any other suitable means.

Figure 28A:
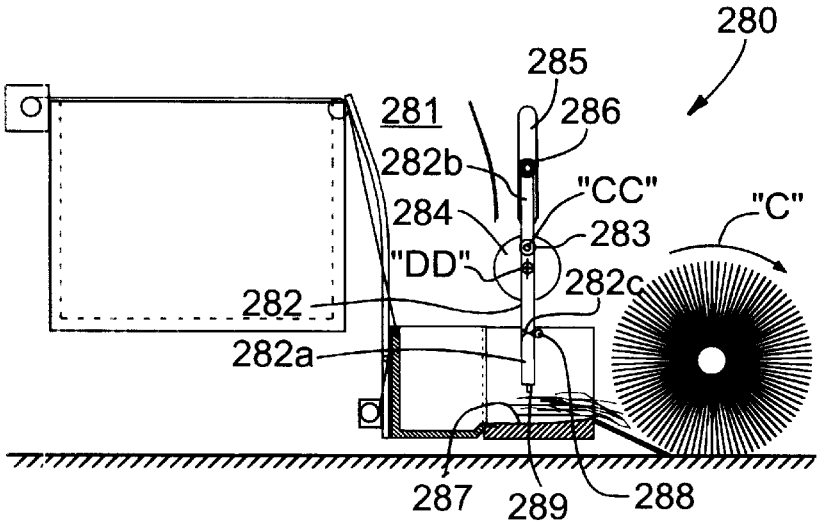
FIGS. 28A through 28C are each side elevational views similar to FIG. 2, but of a tenth alternative embodiment of the debris lifting apparatus according to the present invention.
Figure 28B:
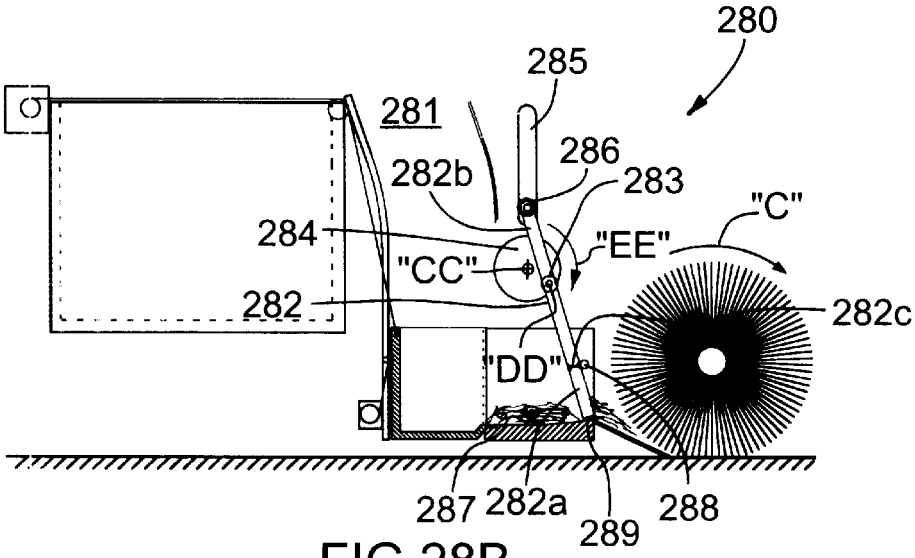
Figure 28C:
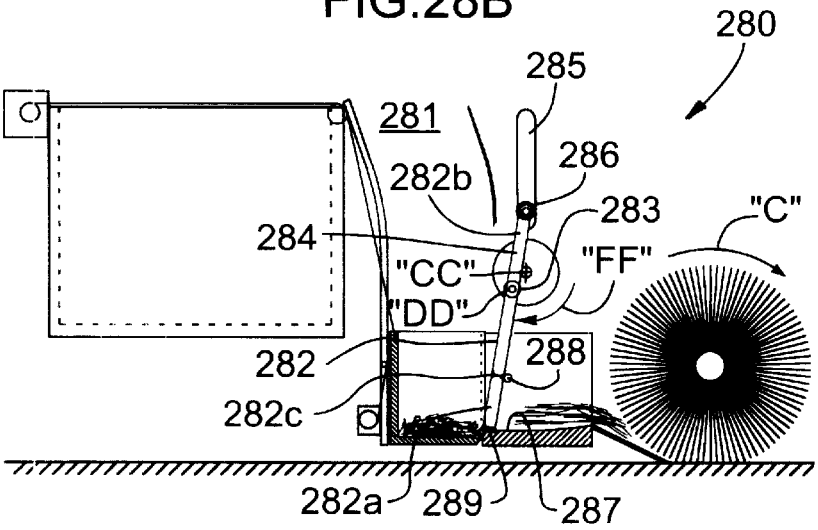

In yet another alternative embodiment of the debris lifting apparatus according to the present invention, as indicated by the general reference numeral 280 in a surface sweeping vehicle 281, specifically the tenth alternative embodiment as illustrated in FIGS. 28A through 28C, the stop wall 282 is pivotally mounted by a bearing 283 on an eccentric mounting means 284 for pivotal movement about a second horizontal pivot axis "DD". The eccentric mounting means 284 is pivotally mounted on the surface sweeping vehicle 281 for the selective pivotal movement about the substantially first horizontal pivot axis "CC", thus causing revolving movement of the second pivot axis "DD". Also, the top end of the stop wall 282 is pivotally slidably mounted in a vertical slot 285 by a bearing 286. In this manner, the alternative embodiment stop wall 282 is in its debris passing position in FIG. 28A, moves around and downwardly from its debris passing position to the debris receiving tray, as shown by arrow "EE" in FIG. 28B, and pushes debris along the debris receiving tray 287 until it reaches its debris stopping position, as shown by arrow "FF" in FIG. 28C, from which position the stop wall 282 moves upwardly and around to again reach its debris passing position as shown in FIG. 28A. Further, a bottom portion 282*a* of the stop wall 282 is pivotally mounted on the main body portion 282*b* by a hinge member 282*c*, thus permitting the bottom portion 282*a* to pivot upwardly and rearwardly in the event of contact with solid debris such as a tire peel or a tree branch, and so on. The bottom portion 282*a* is spring biased into its extended position whereat it is substantially aligned with the main body portion 282*b* by spring member 288. A rubber wear strip 289 extends along the bottom edge of the stop wall for sealed sliding contact with the debris receiving tray 287.

Figure 29:
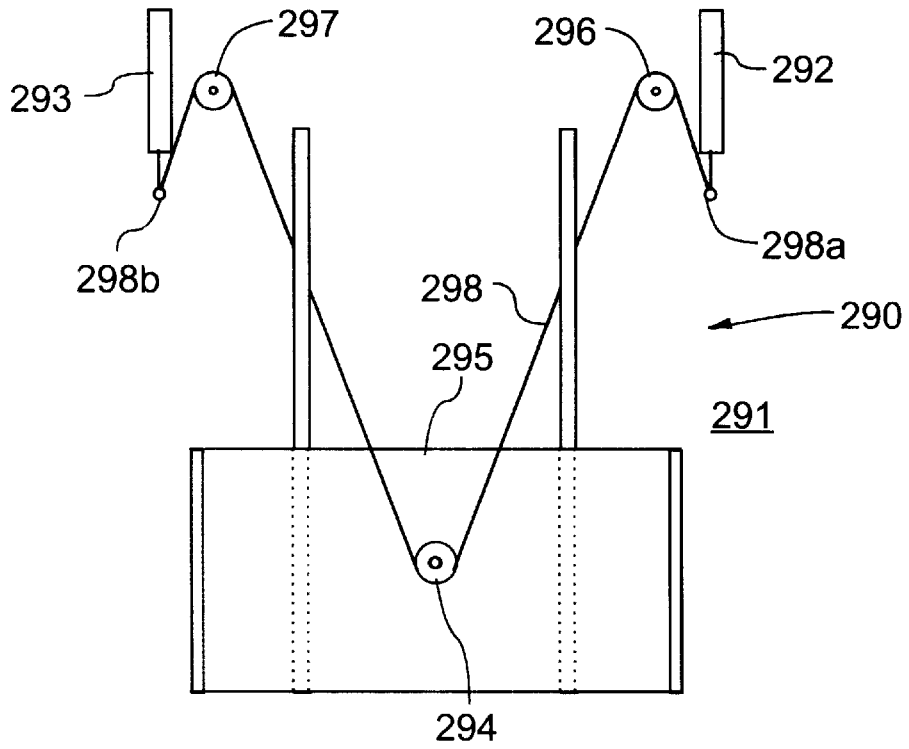
FIG. 29 is an end elevational view of an eleventh alternative embodiment of the debris lifting apparatus according to the present invention with details omitted for the sake of clarity.

In an eleventh alternative embodiment of the debris lifting apparatus according to the present invention, as indicated by the general reference numeral 290 in a surface sweeping vehicle 291, as illustrated in FIG. 29, the selectively operable drive means comprises a first mechanical power device 292 comprising a first hydraulically actuated piston mechanism and a second mechanical power device 293 comprising a second hydraulically actuated piston mechanism each mounted on the surface sweeping vehicle 291. A first freely rotatable pulley 294 is mounted on the isolated debris lifting receptacle 295, a second freely rotatable pulley 296 is mounted on the surface sweeping vehicle 291 to the right of the first freely rotatable pulley 294, and a third freely rotatable pulley 297 is mounted on the surface sweeping vehicle 291 to the left of the first freely rotatable pulley 294. A cable 298 is operatively retained at its first end 298*a* in driven relation by the first hydraulically actuated piston mechanism 292 and operatively retained at its second end 298*b* in driven relation by the second hydraulically actuated piston mechanism 293. The cable 298 engages the first freely rotatable pulley 294 in underslung relation, and engages the second and third freely rotatable pulleys 296, 297 in overslung relation, so as to permit selective lifting of the isolated debris lifting receptacle 295 by the cable 298, as powered by the first and second hydraulically actuated piston mechanisms 292, 293.

Figure 30A:
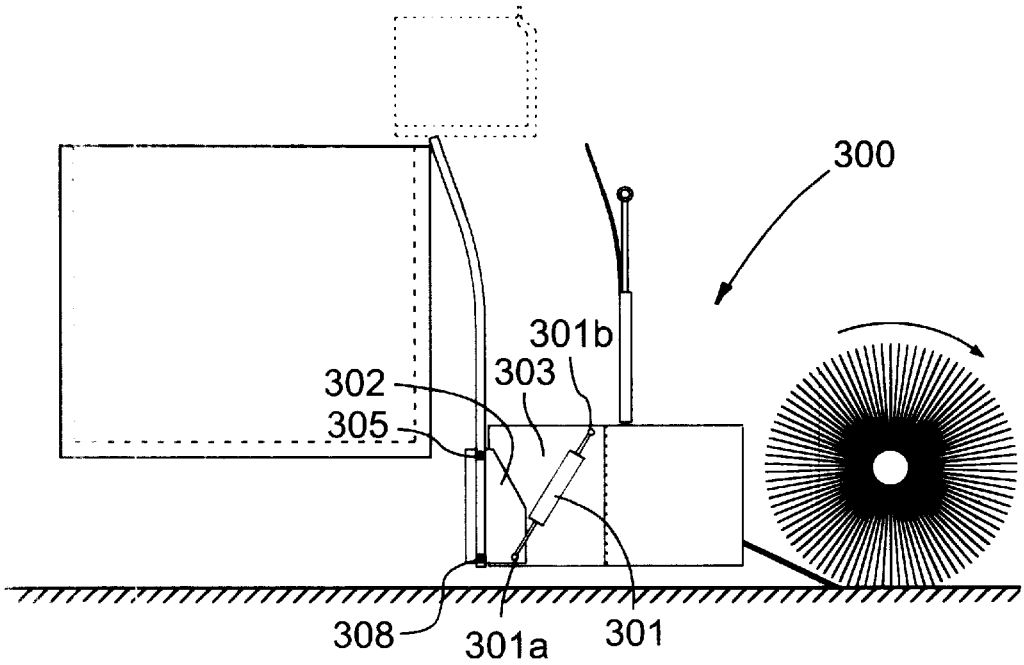
FIG. 30A is a sectional side elevational view similar to FIG. 2, but of a twelfth alternative embodiment of the debris lifting apparatus according to the present invention.
Figure 30B:
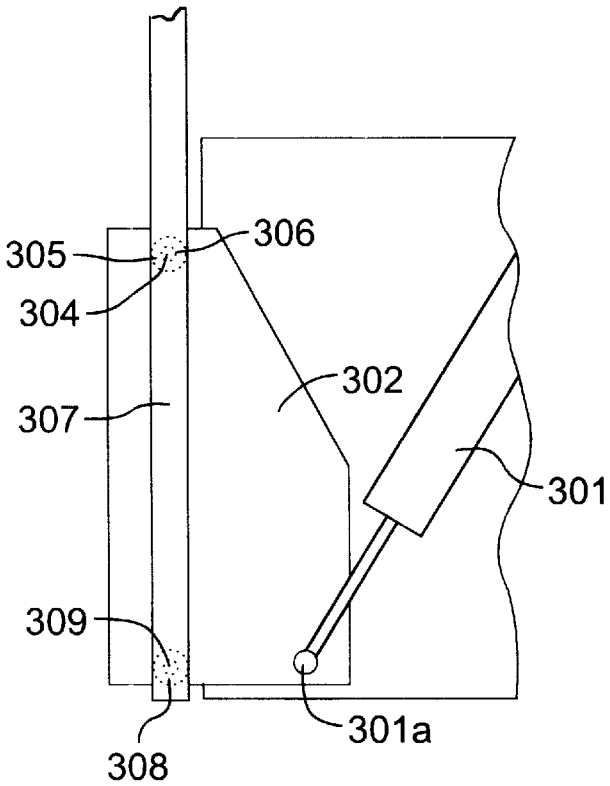
FIG. 30B is an enlarged side elevational view of a portion of FIG. 30A; and, FIG. 31 is a sectional side elevational view similar to FIG. 2, but of a thirteenth alternative embodiment of the debris lifting apparatus according to the present invention.

In another alternative embodiment of the debris lifting apparatus according to the present invention, specifically the twelfth, as indicated by the general reference numeral 300, and as illustrated in FIGS. 30A, 30B, the dumping means comprises a hydraulically actuated piston mechanism 301 having one end 301*a* connected to a mounting plate 302 and the opposite other end 301*b* connected to the isolated debris lifting receptacle 303. As can be best seen in FIG. 30B, the mounting plate 302 is freely pivotally mounted about the shaft member 304 of the first pilot member 305, which shaft member 304 extends through a co-operating aperture 306 in the mounting plate 302. The first pilot member 305 is engaged in the guide track 307. A second pilot member 308 is rotatably mounted on a shaft member 309 that is securely mounted on the mounting plate 302, and is also engaged in the guide track 307. When the isolated debris lifting receptacle 303 reaches its raised debris dumping position, the hydraulically actuated piston mechanism 301 is actuated so as to cause the isolated debris lifting receptacle 303 to be angularly displaceable from its debris retaining orientation, shown in solid lining, to a debris dumping orientation, shown in ghost lining.

Figure 31:
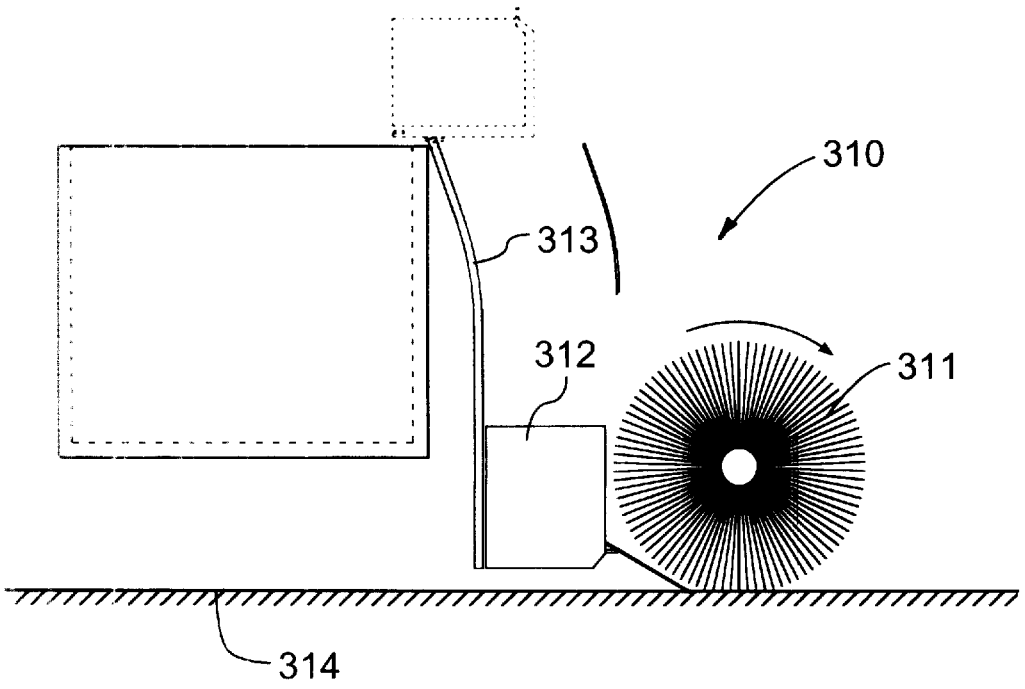

In a thirteenth and final alternative embodiment of the debris lifting apparatus of the present invention, as indicated by the general reference number 310, and as illustrated in FIG. 31, the debris lifting apparatus 310 does not include a stop wall and does not include a debris receiving tray, which stop wall and debris receiving tray are included in other embodiments described above. The debris swept forwardly by the rotating sweeping broom 311 is received by the isolated debris lifting receptacle 312 only, when the isolated debris lifting receptacle 312 is in its lower debris receiving position, as illustrated in solid lining. When the isolated debris lifting receptacle is moved along the guide track 313 to its raised debris dumping position (illustrated in ghost outline), the debris swept forwardly by the rotating sweeping broom 311 is temporarily swept forwardly along the surface 314 being swept, and subsequently swept into the isolated debris lifting receptacle upon return to its debris receiving position. Alternatively, sweeping is temporarily halted until the isolated debris lifting receptacle 312 returns to its debris receiving position.

The present invention also comprises a method of lifting debris that has been propelled forwardly by the sweeping broom into the hopper of the surface sweeping vehicle 30. The method comprises the following steps:

An isolated debris lifting receptacle is arrestedly positioned in a lower debris receiving position, preferably with the arrested positioning being a paused positioning. Debris is continually propelled forwardly and upwardly from a surface being swept by means of the rotating sweeping broom, onto a debris receiving tray and into isolated debris lifting receptacle, with some of the forwardly propelled debris first deflecting off a deflector flap. The forwardly propelled debris that is received in the isolated debris lifting receptacle is subsequently lifted to a hopper. A stop wall is positioned in a debris passing position, whereat the stop wall permits passage of the debris from the rotating sweeping broom to the isolated debris lifting receptacle. When the isolated debris lifting receptacle is to be emptied, the stop wall is moved along the debris receiving tray so as to thereby push debris along the debris receiving tray and into the isolated debris lifting receptacle. The stop wall is then positioned in a debris stopping position, whereat the stop wall receives the debris from the rotating sweeping broom. The isolated debris lifting receptacle is then transferred to a raised debris dumping position, while the rotating sweeping broom is propelling the debris forwardly, which debris is stopped by the stop wall so as to fall onto the debris receiving tray. The debris in the isolated debris lifting receptacle is dumped from the isolated debris lifting receptacle into the hopper by angularly displacing the isolated debris lifting receptacle about a substantially horizontal axis, from a debris retaining orientation to a debris dumping orientation. The isolated debris lifting receptacle is then returned to the lower debris receiving position. Preferably, the transferring of the isolated debris lifting receptacle to a raised debris dumping position and the returning the isolated debris lifting receptacle to the lower debris receiving position are performed along a single common path. The stop wall is then repositioned in its debris passing position, and may first be used to push the debris collected in the debris receiving tray into the isolated debris lifting receptacle. The above steps are repeated, as necessary, during the operation of the surface sweeping vehicle, thus permitting the maintaining of continuous sweeping of the rotating sweeping broom and continuous capture of the debris swept forwardly by the sweeping broom.

It can readily be seen that, relating to the objects of the present invention, the debris lifting apparatus of the present invention provides an apparatus for lifting dirt and debris swept forwardly by the sweeping broom and depositing the dirt and debris into a hopper, which apparatus requires less frequent replacement of parts, uses parts that are not readily bent or otherwise damaged, has improved wear characteristics and lower maintenance costs, as compared to prior art conveyors. Further, the debris lifting apparatus of the present invention can lift large debris without jamming. The present debris lifting apparatus includes a debris lifting component that has an arrested debris receiving position whereat even when the debris lifting component is not in its debris receiving position, debris swept forwardly is temporarily accumulated. Further, the temporarily accumulated debris is moved into the debris lifting component upon its return to its debris receiving position.

Other variations of the above principles will be apparent to those who are knowledgeable in the field of the invention, and such variations are considered to be within the scope of the present invention. Further, other modifications and alterations may be used in the design and manufacture of the apparatus of the present invention without departing from the spirit and scope of the accompanying claims.

I claim:

1. A debris lifting apparatus for use in a surface sweeping vehicle having front and back ends, a rotating sweeping broom that propels debris forwardly, and a hopper to receive and retain said debris, said debris lifting apparatus comprising:

an isolated debris lifting receptacle operatively mounted on said surface sweeping vehicle by a receptacle mounting means for arrested positioning in a lower debris receiving position, whereat said isolated debris lifting receptacle is disposed to receive and retain said debris propelled forwardly by said rotating sweeping broom, and for positioning in a raised debris dumping position, whereat said isolated debris lifting receptacle is disposed to dump said debris retained therein into said hopper;

selectively operable drive means mounted on said surface sweeping vehicle and connected in driving relation to said isolated debris lifting receptacle to effect movement of said isolated debris lifting receptacle between said lower debris receiving position and said raised debris dumping position;

dumping means mounted on said surface sweeping vehicle to effect dumping of said debris from said isolated debris lifting receptacle into said hopper when said isolated debris lifting receptacle is in said raised debris dumping position;

a debris receiving tray defined by a debris ingress edge, a debris egress edge, left side and right side edges, and mounted on said surface sweeping vehicle between said rotating sweeping broom and said debris lifting apparatus so as to receive debris swept forwardly by said rotating sweeping broom; and, a stop wall defined by a top edge, a bottom edge, a left side edge, and a right side edge, and having a debris impinging surface, and being operatively mounted on said surface sweeping vehicle for return movement from a debris passing position temporally coincident with said lower debris receiving position of said isolated debris lifting receptacle and whereat said stop wall is disposed to permit passage of said debris from said rotating sweeping broom to said isolated debris lifting receptacle, to a debris stopping position temporally coincident with said raised debris dumping position and whereat said stop wall is disposed to receive said debris from said rotating sweeping broom, and permit said debris to fall into said debris receiving tray.

2. The debris lifting apparatus of claim 1, wherein said stop wall is mounted generally above said debris receiving tray, and further comprises a receptacle facing surface that pushes debris along said debris receiving tray and into said isolated debris lifting receptacle when said stop wall moves from said debris stopping position to said debris passing position.

3. The debris lifting apparatus of claim 2, wherein said receptacle facing surface of said stop wall also pushes debris along said debris receiving tray and into said isolated debris lifting receptacle when said stop wall moves from said debris passing position to said debris stopping position.

4. The debris lifting apparatus of claim 1, wherein said arrested positioning is a paused positioning.

5. The debris lifting apparatus of claim 1, wherein said isolated debris lifting receptacle travels along a single common path from said lower debris receiving position to said raised debris dumping position and back to said lower debris receiving position.

6. The debris lifting apparatus of claim 1, wherein said receptacle mounting means comprises a guide track means attached to said surface sweeping vehicle and operatively engaged in guiding relation with a co-operating pilot member attached to said isolated debris lifting receptacle to guide said isolated debris lifting receptacle in its said lower debris receiving position and said raised debris dumping position.

7. The debris lifting apparatus of claim 6, wherein said guide track means comprises left and right guide tracks mounted in opposed facing relation one to the other.

8. The debris lifting apparatus of claim 1, wherein said isolated debris lifting receptacle is angularly displaceable about a substantially horizontal axis, by said dumping means, from a debris retaining orientation to a debris dumping orientation.

9. The debris lifting apparatus of claim 1, wherein said receptacle mounting means comprises at least one lever arm pivotally mounted on said surface sweeping vehicle and said drive means comprises a hydraulically actuated piston mechanism.

10. A method of lifting debris into the hopper of a surface sweeping vehicle having a rotating sweeping broom, said method comprising the steps of:

(a) arrestedly positioning an isolated debris lifting receptacle in a lower debris receiving position;

($a_2$) positioning a stop wall in a debris passing position, whereat said stop wall permits passage of said debris from said rotating sweeping broom to said isolated debris lifting receptacle;

(b) propelling said debris forwardly and upwardly from a street being cleaned by means of said rotating sweeping broom;

(c) receiving said forwardly propelled debris in said isolated debris lifting receptacle;

($c_2$) positioning said stop wall in a debris stopping position, whereat said stop wall receives said debris from said rotating sweeping broom, so as to permit said debris to fall into a debris receiving tray;

(d) transferring said isolated debris lifting receptacle to a raised debris dumping position, while said rotating sweeping broom is propelling said debris forwardly;

(e) dumping said debris from said isolated debris lifting receptacle into said hopper;

(f) returning said isolated debris lifting receptacle to said lower debris receiving position; and, (g) repeating steps (a) through (f) during the operation of said surface sweeping vehicle.

11. The method of claim 10, wherein said arrested positioning is a paused positioning.

12. The method of claim 11, wherein said transferring of said isolated debris lifting receptacle to a raised debris dumping position in step (d) and said returning said isolated debris lifting receptacle to said lower debris receiving position in step (f) are performed along a single common path.

13. The method of claim 12, wherein said transferring said isolated debris lifting receptacle to a raised debris dumping position in step (d) and said returning said isolated debris lifting receptacle to said lower debris receiving position in step (f) are performed along a guide track means.

14. The method of claim 13, wherein the step (e) of dumping said debris into said hopper crises angularly displacing said isolated debris lifting receptacle about a substantially horizontal axis, from a debris retaining orientation to a debris dumping orientation.

15. The method of claim 14, further comprising the sub-step of:

after step ($c_2$) and after step (a), and prior to the next occurrence of step ($a_2$):

($a_{1.1}$) moving said stop wall along said deflector flap so as to thereby push debris along said debris receiving tray and into said isolated debris lifting receptacle.

16. A stop wall for use in a debris lifting apparatus mounted in a surface sweeping vehicle, said debris lifting apparatus including an isolated debris lifting receptacle having a lower debris receiving position and a raised debris dumping position, a debris receiving tray mounted on said surface sweeping vehicle between said rotating sweeping broom and said debris lifting apparatus so as to receive debris swept forwardly by said rotating sweeping broom, said stop wall comprising:

a top edge, a bottom edge, a left side edge, and a right side edge;

a debris impinging surface;

wherein said stop wall is operatively mounted on said surface sweeping vehicle for return movement from a debris passing position temporally coincident with said lower debris receiving position of said isolated debris lifting receptacle and whereat said stop wall is disposed to permit passage of said debris from said rotating sweeping broom to said isolated debris lifting receptacle, to a debris stopping position temporally coincident with said raised debris dumping position and whereat said stop wall is disposed to receive said debris from said rotating sweeping broom.

17. The stop wall of claim 16, wherein said stop wall is mounted generally above said debris receiving tray, and further comprises a receptacle facing surface that pushes debris along said debris receiving tray and into said isolated debris lifting receptacle when said stop wall moves from said debris stopping position to said debris passing position.

* * * * *